US010018341B2

(12) United States Patent
Madril

(10) Patent No.: US 10,018,341 B2
(45) Date of Patent: Jul. 10, 2018

(54) METHOD AND APPARATUS FOR A LIGHT COLLECTION AND PROJECTION SYSTEM

(71) Applicant: JST Performance, LLC, Gilbert, AZ (US)

(72) Inventor: Edgar A. Madril, Mesa, AZ (US)

(73) Assignee: JST Performance, LLC, Gilbert, AZ (US)

( * ) Notice: Subject to any disclaimer, the term of this patent is extended or adjusted under 35 U.S.C. 154(b) by 0 days.

(21) Appl. No.: 15/250,055

(22) Filed: Aug. 29, 2016

(65) Prior Publication Data

US 2016/0363302 A1 Dec. 15, 2016

Related U.S. Application Data

(63) Continuation-in-part of application No. 14/448,050, filed on Jul. 31, 2014.

(51) Int. Cl.

| | |
|---|---|
| ***F21V 5/00*** | (2018.01) |
| ***F21V 23/00*** | (2015.01) |
| ***F21V 3/02*** | (2006.01) |
| ***F21V 29/76*** | (2015.01) |
| ***F21V 5/04*** | (2006.01) |
| *F21Y 115/10* | (2016.01) |

(52) U.S. Cl.

CPC ..... *F21V 23/005* (2013.01); *F21V 3/02* (2013.01); *F21V 5/007* (2013.01); *F21V 5/04* (2013.01); *F21V 29/76* (2015.01); *F21Y 2115/10* (2016.08)

(58) Field of Classification Search

CPC . F21V 5/007; F21V 5/04; F21V 5/045; F21V 3/02; G02B 3/02; G02B 3/08; G02B 3/10; F21S 48/1154; F21S 48/1258; F21S 48/115; F21S 48/1216; F21S 48/1275; F21S 48/1283; F21S 48/1291

See application file for complete search history.

(56) References Cited

U.S. PATENT DOCUMENTS

| | | | |
|---|---|---|---|
| 1,901,012 | A | 3/1933 | Tourriol |
| 2,084,254 | A | 6/1937 | Hoal |
| 2,241,128 | A | 5/1941 | Harley |
| 4,210,391 | A | 7/1980 | Cohen |
| 4,254,453 | A | 3/1981 | Mouyard et al. |
| 4,733,335 | A | 3/1988 | Serizawa et al. |

(Continued)

OTHER PUBLICATIONS http://www.aliexpress.com/store/product/3-inch-Original-Q5-Projector-Lens-Bifocal-Headlight-model-for-D1S-D2S-D3S-D4S-and-High/1052071_1901021445.html.

*Primary Examiner* — Alexander Garlen

(57) ABSTRACT

A method and apparatus for collecting and projecting light into a specified target illuminance. A lens may be mounted or otherwise paired to a carrier to form a lens/carrier combination, which may then be mounted to a printed circuit board assembly (PCBA) containing a light emitting diode (LED). The lens/carrier combination may establish an optimum optical relationship between the LED and the lens, such that a predetermined photometric distribution of the LED is collected by the lens, while the remaining photometric distribution of the LED is rejected by the carrier. The lens may include a first pair of opposing surfaces forming a first focus and a second pair of opposing surfaces forming a second focus. The first and second foci may cause light to be subtended into one or more of collimated light focused light, diffused light, and shifted light. The carrier may include an obstruction extending toward the PCBA.

20 Claims, 16 Drawing Sheets

(56) References Cited

U.S. PATENT DOCUMENTS 4,918,580 A 4/1990 Nino
5,083,245 A 1/1992 Fray et al.
5,400,226 A 3/1995 Hogrefe
5,416,678 A 5/1995 Schabowski
5,442,488 A 8/1995 Pastorino
6,036,338 A 3/2000 Gordin
6,283,613 B1 9/2001 Schaffer
7,255,467 B2 * 8/2007 Ishida ..... F21S 48/1154 257/E33.059
7,311,430 B2 12/2007 Tsukamoto et al.
7,357,545 B2 4/2008 Stefka et al.
7,648,262 B2 1/2010 Tanaka
7,722,210 B2 5/2010 Tessnow et al.
7,736,036 B2 * 6/2010 Tatsukawa ..... F21S 48/1154 359/726
7,762,697 B2 * 7/2010 Yagi ..... F21S 48/1154 362/309
7,914,162 B1 3/2011 Huang
8,174,740 B2 5/2012 Baxter et al.
9,103,518 B2 8/2015 Owada
2005/0030759 A1 2/2005 Zollers
2006/0268548 A1 11/2006 Chang
2008/0084694 A1 4/2008 Rose et al.
2010/0195330 A1 8/2010 Schaefer et al.
2011/0096561 A1 * 4/2011 Owada ..... F21S 48/1154 362/521
2011/0249434 A1 10/2011 McQuistian et al.
2012/0075877 A1 * 3/2012 Chang ..... F21V 5/04 362/520
2012/0147589 A1 6/2012 Farmer
2012/0188781 A1 * 7/2012 Futami ..... F21S 48/1154 362/516
2012/0235027 A1 * 9/2012 Sangu ..... G01J 5/0025 250/214.1
2013/0093325 A1 4/2013 Scarpelli
2013/0229796 A1 9/2013 Tseng et al.
2015/0043239 A1 * 2/2015 Han ..... F21S 48/1283 362/520
2015/0260367 A1 * 9/2015 Iwasaki ..... F21S 48/1266 362/522

* cited by examiner

METHOD AND APPARATUS FOR A LIGHT COLLECTION AND PROJECTION SYSTEM

FIELD OF THE INVENTION

The present invention generally relates to lighting systems, and more particularly to light collection and projection systems.

BACKGROUND

Light emitting diodes (LEDs) have been utilized since about the 1960s. However, for the first few decades of use, the relatively low light output and narrow range of colored illumination limited the LED utilization role to specialized applications (e.g., indicator lamps). As light output improved, LED utilization within other lighting systems, such as within LED "EXIT" signs and LED traffic signals, began to increase. Over the last several years, the white light output capacity of LEDs has more than tripled, thereby allowing the LED to become the lighting solution of choice for a wide range of lighting solutions.

LEDs exhibit significantly optimized characteristics for use in lighting fixtures, such as source efficacy, optical control and extremely long operating life, which make them excellent choices for general lighting applications. LED efficiencies, for example, may provide light output magnitudes that may exceed 100 lumens per watt of power dissipation. Energy savings may, therefore, be realized when utilizing LED-based lighting systems as compared to the energy usage of, for example, incandescent, halogen, compact fluorescent and mercury lamp lighting systems. As per an example, an LED-based lighting fixture may utilize a small percentage (e.g., 10-15%) of the power utilized by an incandescent bulb, but may still produce an equivalent magnitude of light.

LEDs may be mounted to a printed circuit board (PCB) or printed circuit board assembly (PCBA), which may include conductive regions (e.g., conductive pads) and associated control circuitry. The LED control terminals (e.g., the anode and cathode terminals of the LEDs) may be interconnected via the conductive pads, such that power supply and bias control signals may be applied to transition the LEDs between conductive and non-conductive states, thereby illuminating the LEDs on command.

The photometric distribution of a forward-biased LED may produce an omnidirectional pattern of light (e.g., a 180 degree spread of light emanating in all directions from a surface of the PCB upon which the LED is mounted). In order to modify such an omnidirectional photometric distribution, a plastic dome (e.g., an injection molded acrylic plastic cover) may be placed over the LED. In so doing, for example, the plastic dome may modify the photometric distribution pattern from that of an omnidirectional pattern to one of a non-omnidirectional pattern (e.g., a 120 degree spread of light emanating from a surface of the PCB). A lens may be mounted forward of the LED to further control the photometric distribution of the LED.

A system of one or more LEDs and associated lenses may, for example, be implemented within an LED-based lighting system. Each LED of such a system, however, may exhibit a photometric distribution such that the light emitted by one LED may be projected into one or more lenses that may be associated with one or more adjacent LEDs. In such an instance, for example, one lens may receive the light generated by one or more adjacent LEDs (e.g., interference light), which may adversely affect the pattern of light projected by the LED-based lighting system.

Efforts continue, therefore, to develop a multiple LED lighting system that reduces adverse interference light.

SUMMARY

To overcome limitations in the prior art, and to overcome other limitations that will become apparent upon reading and understanding the present specification, various embodiments of the present invention disclose methods and apparatus for the collection and projection of light in an LED-based lighting system.

In accordance with one embodiment of the invention, an LED-based lighting system comprises a PCBA having an LED, a carrier coupled to the PCBA, and a lens. The carrier includes an aperture in a geometric relationship with the LED. The lens is configured to subtend light received from the LED through the aperture. The lens includes a first set of opposing surfaces forming a first focus and a second set of opposing surfaces forming a second focus.

In accordance with another embodiment of the invention, an LED-based lighting system comprises a PCBA having first and second LEDs, a carrier coupled to the PCBA, and a lens structure with at least one obstruction. The carrier includes first and second apertures. The lens includes first and second lenses. The lens structure is coupled to the carrier to receive light from the first and second LEDs through the first and second apertures, respectively. The at least one obstruction extends from the carrier to prevent light from the first LED from entering the second lens and to prevent light from the second LED from entering the first lens.

In accordance with another embodiment of the invention, a method comprises emitting light from an LED in an effective span of emission. The method further includes passing a first portion of the effective span through a first discrete region of a lens to produce a first subtended span of light. The method further includes passing a second portion of the effective span through a second discrete region of the lens to produce a second subtended span of light. The method further includes preventing substantially all remaining light of the effective span of emission from passing through the lens.

BRIEF DESCRIPTION OF THE DRAWINGS

Various aspects and advantages of the invention will become apparent upon review of the following detailed description and upon reference to the drawings in which.

DETAILED DESCRIPTION

Figure 1:
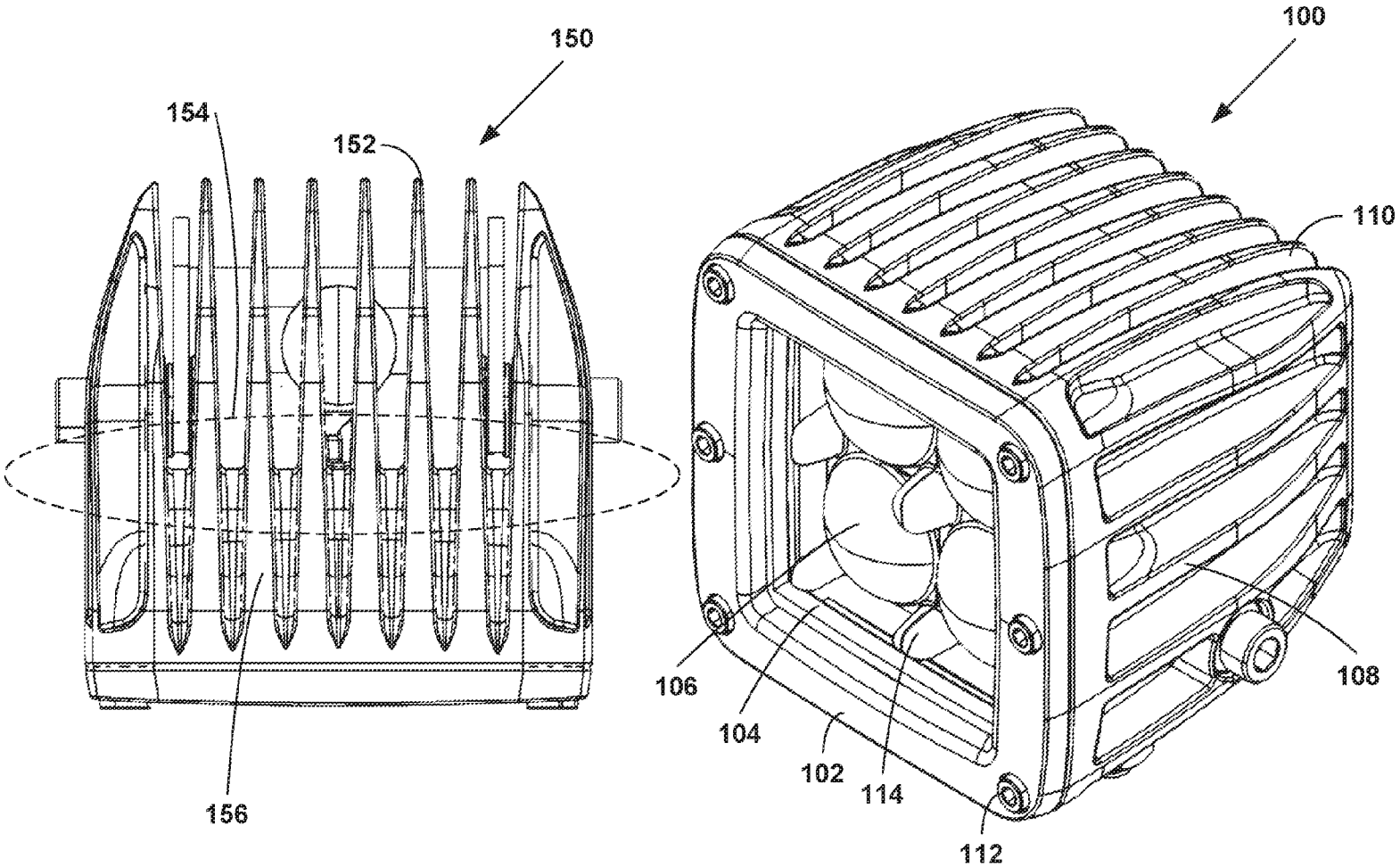
FIG. 1 illustrates an LED-based lighting fixture in accordance with one embodiment of the present invention.

Generally, the various embodiments of the present invention are applied to a light emitting diode (LED) based lighting system that may contain one or more LEDs and one or more associated lenses. The LEDs may be mounted to a PCB having control and bias circuitry that allows the LEDs to be illuminated on command. A lens may be mounted forward of an associated LED, so as to control a pattern of light that may be projected by each LED of the lighting system.

A carrier may be used to facilitate the mounting of the lens forward of its associated LED. For example, a carrier may exhibit a locking mechanism (e.g., a friction-based, male locking mechanism) that may be compatible with a corresponding locking mechanism (e.g., a friction-based, female locking mechanism) of the corresponding lens. Once interlocked (e.g., once the lens is "snapped" into place within the carrier), the lens may be secured within the carrier to form a carrier/lens combination, such that the position of the lens relative to the orientation of the carrier may create an optimal geometric relationship between the lens and the carrier. Alternately, for example, the carrier and lens may not necessarily include interlocking mechanisms.

The carrier may, for example, include one or more extrusions (e.g., legs) having indexing features (e.g., feet) that may allow the carrier/lens combination to be secured to a PCB at a particular orientation as defined by the indexing features. The PCB may, for example, include corresponding indexing features (e.g., holes) that may be configured to accept the indexing features of the carrier, such that once the carrier/lens combination engages the indexing features of the PCB, a position of the carrier/lens combination relative to the orientation of the PCB maintains an optimal geometric relationship between the LED mounted to the PCB and its corresponding carrier/lens combination.

The carrier/lens combination may couple a predetermined portion of the photometric distribution of its corresponding LED, such that the predetermined portion may be allowed to be projected into the corresponding carrier/lens combination, while the remaining portion of the photometric distribution may be disallowed from entering the corresponding carrier/lens combination. Furthermore, the remaining portion of the photometric distribution of an LED that may be disallowed from entering the corresponding carrier/lens combination, may also be prevented from entering the carrier/lens combinations associated with neighboring LEDs, if any, in the LED-based lighting system.

Each carrier of each carrier/lens combination may be configured with a bowl structure that is narrow at one end and wider at the other end. The narrow end of each carrier may be configured with an aperture such that once the carrier/lens combination engages the PCB, the aperture may be positioned over the corresponding LED to establish a geometric relationship between the LED and the aperture (e.g., an optimal separation distance between the aperture and the LED). Furthermore, the aperture may be beveled, or flanged, so as to present an aperture having an inner wall that is not perpendicular to an optical axis of its corresponding LED, but is rather angled with respect to an optical axis of its corresponding LED. Accordingly, for example, light emanating from the LED at an angle greater than the angle formed by the inside wall of the aperture may be projected onto its corresponding lens, while light emanating from the LED at an angle less than the angle formed by the inside wall of the aperture may be prohibited from projecting onto its corresponding lens.

The bowl structure of each carrier may be configured to reduce, or eliminate, reflections of light that may be incident onto the bowl structure. For example, the bowl structure may exhibit a surface that provides hard optical angles (e.g., a stair-stepped surface or a rounded stair-stepped surface) such that any light incident on the bowl structure may be reflected, if at all, away from the corresponding lens. In addition, the bowl structure may exhibit a non-reflective color (e.g., black) so as to be substantially non-reflective of any light that may be incident on the bowl structure. Further, the bowl structure may exhibit a non-reflective texture (e.g., a coarse texture) so as to be substantially non-reflective of any light that may be incident on the bowl structure.

An optical system that may include a PCB, an LED, and a carrier/lens combination may combine to substantially project a portion of the light emitted from the LED onto its corresponding lens, while substantially rejecting all other light that may otherwise be incident on the corresponding lens (e.g., reflected light from the corresponding LED or incident light from neighboring LEDs). Accordingly, the light projected by the LED-based lighting system may exhibit a specified target illuminance (e.g., a spot beam pattern), while rejecting substantially all other light that might otherwise exist outside of the target illuminance (e.g., spill light outside of the spot beam pattern).

The lens of each carrier/lens combination may exhibit various configurations. For example, the lens may exhibit two convex surfaces (e.g., a biconvex configuration), or may exhibit a flat surface on one side of the lens and a convex surface on the other side of the lens (e.g., a plano-convex configuration). The lens may, for example, exhibit two convex surfaces, where the radius of curvature of one convex surface may be different than the radius of curvature of the other convex surface. The lens may, for example, exhibit two convex surfaces, where the radius of curvature of one convex surface may be the same as the radius of curvature of the other convex surface (e.g., a equi-convex configuration). The lens may, for example, exhibit an optical surface that may be broken up into narrow, concentric rings (e.g., a Fresnel lens configuration), such that the lens may be manufactured to be thinner and, therefore, lighter than the convex or plano-convex configurations.

Once the photometric distribution of an LED of an LED-based lighting system has been controlled into an initial target illuminance (e.g., a spot beam pattern), other optical treatments may be applied to effect a subsequent target illuminance that may be produced from the initial target illuminance. For example, a supplemental optic (e.g., a diffuser) may be used to spread the initial target illuminance into a wider beam pattern that may exhibit attributes that may be beneficial in certain applications. For example, a diffuser may be applied to spread the initial target illuminance into a pattern that may be compliant with standards as promulgated by the U.S. Department of Transportation or the Economic Commission for Europe. An additional diffuser may be applied, for example, whereby the initial target illuminance may be spread by a first diffuser and spread again by a second diffuser (e.g., a first diffuser may spread light along a horizontal axis and a second diffuser may spread the horizontally spread light along a vertical axis).

Turning to FIG. 1, an exemplary LED-based lighting fixture 100 is illustrated, which may include body portion 108 and heat sink portion 110. Body portion 108 may, for example, include one or more lenses 106, a plate (e.g., transparent plate 104), and bezel 102. LED-based lighting fixture 100 may further include one or more carriers (not shown) which may provide a retaining mechanism for lenses 106. LED-based lighting fixture 100 may further include a PCB (not shown) which may include one or more LEDs (not shown), associated LED bias and control circuitry (not shown) and mechanical indexing (not shown) to retain lenses 106 and associated carriers. Transparent plate 104 may be held into place by bezel 102 and associated bezel hardware 112. In addition, transparent plate 104 may be in mechanical communication with extensions 114, such that once bezel 102 is held in place by bezel hardware 112, transparent plate 104 may contact extensions 114 to press lenses 106 and their associated carriers into the corresponding mechanical indexing of the PCB. Accordingly, for example, the optical system within body portion 108 may be held in place via plate 104, bezel 102 and bezel hardware 112 so as to preserve the optimal geometric relationship between the LEDs and associated lenses 106. Alternately, for example, the optical system within body portion 108 may be held in place by other mechanical means (e.g., screws).

A side view of LED-based lighting fixture 150 is illustrated, which exemplifies heat sink fins 152 and their connection to body portion 156. Accordingly, for example, heat sink fins 152 may be in thermal communication with body portion 156 along interface 154, such that heat generated within body portion 156 may be transferred to heat sink fins 152 along interface 154, thereby reducing the temperature of body portion 156 and the electronic components (e.g., LEDs) mounted therein. For example, body portion 156 may contain a PCB (not shown) with LEDs mounted thereon (not shown) that may be in thermal communication with heat sink fins 152 via body portion 156 along interface 154. As the LEDs are illuminated, power may be dissipated by the LEDs into heat, which may then be transferred to heat sink fins 152. Heat sink fins 152 may then conduct the heat into the atmosphere that surrounds heat sink fins 152 thereby reducing the temperature of body portion 156 and reducing the temperature of the LEDs mounted therein.

It should be noted that virtually any light fixture may accommodate an LED-based lighting system having one or more LEDs. For example, single-LED light fixtures, single-row light bars, double-row lights bars, and matrix light fixtures, to name only a few, may accommodate the light collection and projection systems provided herein.

Figure 2:
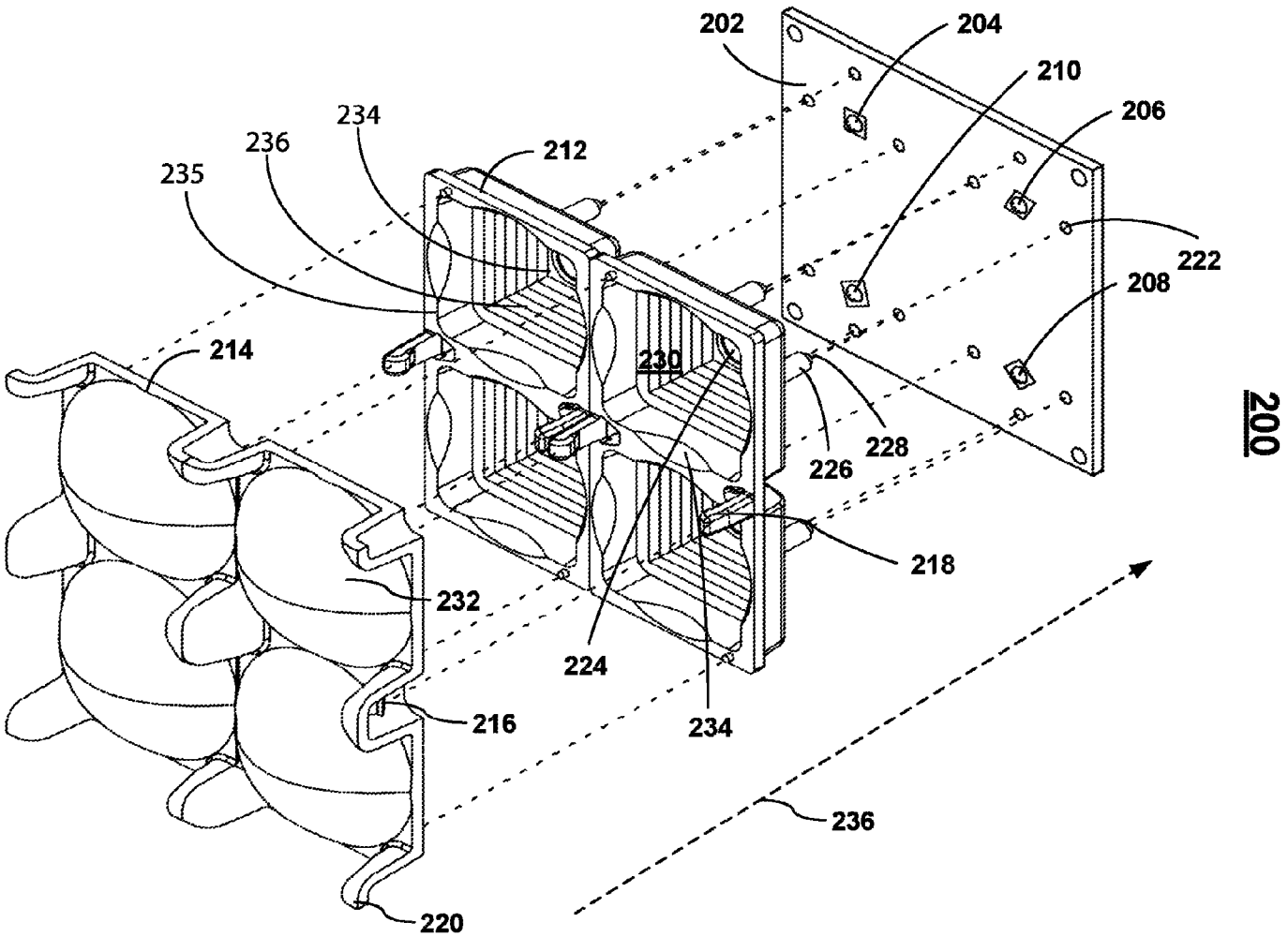
FIG. 2 illustrates a light collection and projection system in accordance with one embodiment of the present invention.

Turning to FIG. 2, an exploded view of light collection and projection system 200 is exemplified, which may include PCB 202 with one or more LEDs (e.g., LEDs 204-210) and associated bias and control circuitry (not shown) mounted thereon. Light collection and projection system 200 may further include carrier 212 that may include one or more bowl structures (e.g., bowl portion 230) and a lens structure 214 that may include one or more lenses 232. PCB 202 may, for example, include mechanical indexing features (e.g., holes 222) that may be associated with corresponding mechanical indexing features (e.g., feet 228) of extension portions (e.g., legs 226) of carrier 212. Once engaged, the mechanical indexing features (e.g., holes 222 and feet 228) of PCB 202 and carrier 212, respectively, may create an optimized geometric relationship between LEDs 204-210 and the corresponding apertures 224 of carrier 212.

Such an optimized geometric relationship may, for example, include an optimized separation distance (e.g., between approximately 0.03 and 0.04 inches) between a bottom portion of carrier 212 (e.g., rearward surface 1622 of FIG. 16) and a top portion of LEDs 204-210 (e.g., forward portion 1605 of FIG. 16) as may be facilitated by extension portions (e.g., legs 226) of carrier 212. Such an optimized separation distance may, for example, facilitate a predetermined portion of the photometric distribution of LEDs 204-210 to be collected by the corresponding apertures 224 of carrier 212. In addition, such an optimized separation distance may, for example, facilitate a predetermined portion of the photometric distribution of LEDs 204-210 to be prohibited from being collected by the corresponding apertures 224 of carrier 212.

Carrier 212 may, for example, include bowl portion 230, which may include a narrow end 234 (e.g., the end of bowl portion 230 that includes aperture 224) and a wide end 235 (e.g., the end of bowl portion 230 that is opposite the narrow end of aperture 224). Bowl portion 230 may include surfaces 236 (e.g., the four inner walls of bowl portion 230) that may exhibit hard optical angles (e.g., a stair-stepped surface) such that any light that may be incident on the four inner walls of bowl portion 230 may be reflected, if at all, away from corresponding lens 232.

It should be noted that manufacturing techniques may somewhat preclude the formation of hard optical angles. In such an instance, for example, the corners of the stair-stepped structure of the inner walls of bowl portion 230 may exhibit a nominal radius of curvature (e.g., 1/32 of an inch). In other words, the corners of the stair-stepped structure of the inner walls of bowl portion 230 may be somewhat rounded.

In addition, bowl portion 230 may exhibit a non-reflective color (e.g., black) so as to be substantially non-reflective of any light that may be incident on bowl portion 230. Further, bowl portion 230 may exhibit a non-reflective texture (e.g., a coarse texture) so as to be substantially non-reflective of any light that may be incident on bowl portion 230.

Bowl portion 230 may include one or more concave recesses 234 that may exist at the wide end 235 of bowl portion 230. Concave recesses 234 may, for example, be configured to receive respective bottom portions (e.g., bottom portion 437 of FIG. 4) of lens 232 after carrier 212 and lens structure 214 are mated to one another to form a carrier/lens assembly. Lens 232 may, for example, exhibit a bi-convex configuration, such that the radius of curvature of a bottom portion (e.g., bottom portion 437 of FIG. 4) of lens 232 matches the radius of curvature of concave recesses 234.

Carrier 212 may include one or more locking mechanisms (e.g., friction-based male locking mechanisms 218) and lens structure 214 may include one or more corresponding locking mechanisms (e.g., friction-based female locking mechanisms 216). Accordingly, for example, once carrier 212 and lens structure 214 are mated to one another to form the carrier/lens assembly, friction-based male locking mechanisms 218 and corresponding friction-based female locking mechanisms 216 may engage each other to lock (e.g., temporarily lock) the carrier/lens assembly in place.

Lens structure 214 may include one or more extensions 220. Extensions 220 may, for example, engage portions of an LED-based lighting fixture (e.g., transparent plate 104 of the LED-based lighting fixture 100), thereby imposing a pressure on extensions 220 along axis 236 to press carrier 212 and lens structure 214 against PCB 202. Accordingly, for example, light collection and projection system 200 may maintain optimized geometric relationships while being operational within the LED-based lighting fixture.

It should be noted that lens structure 214 may not necessarily be a bi-convex structure as shown. Instead, for example, lens structure 214 may include a Fresnel lens, which may exhibit an optical surface that may be broken up into narrow, concentric rings. Other alternatives that may be used as lens structure 214 may include plano-convex configurations and equi-convex configurations to name only a few.

Figure 3:
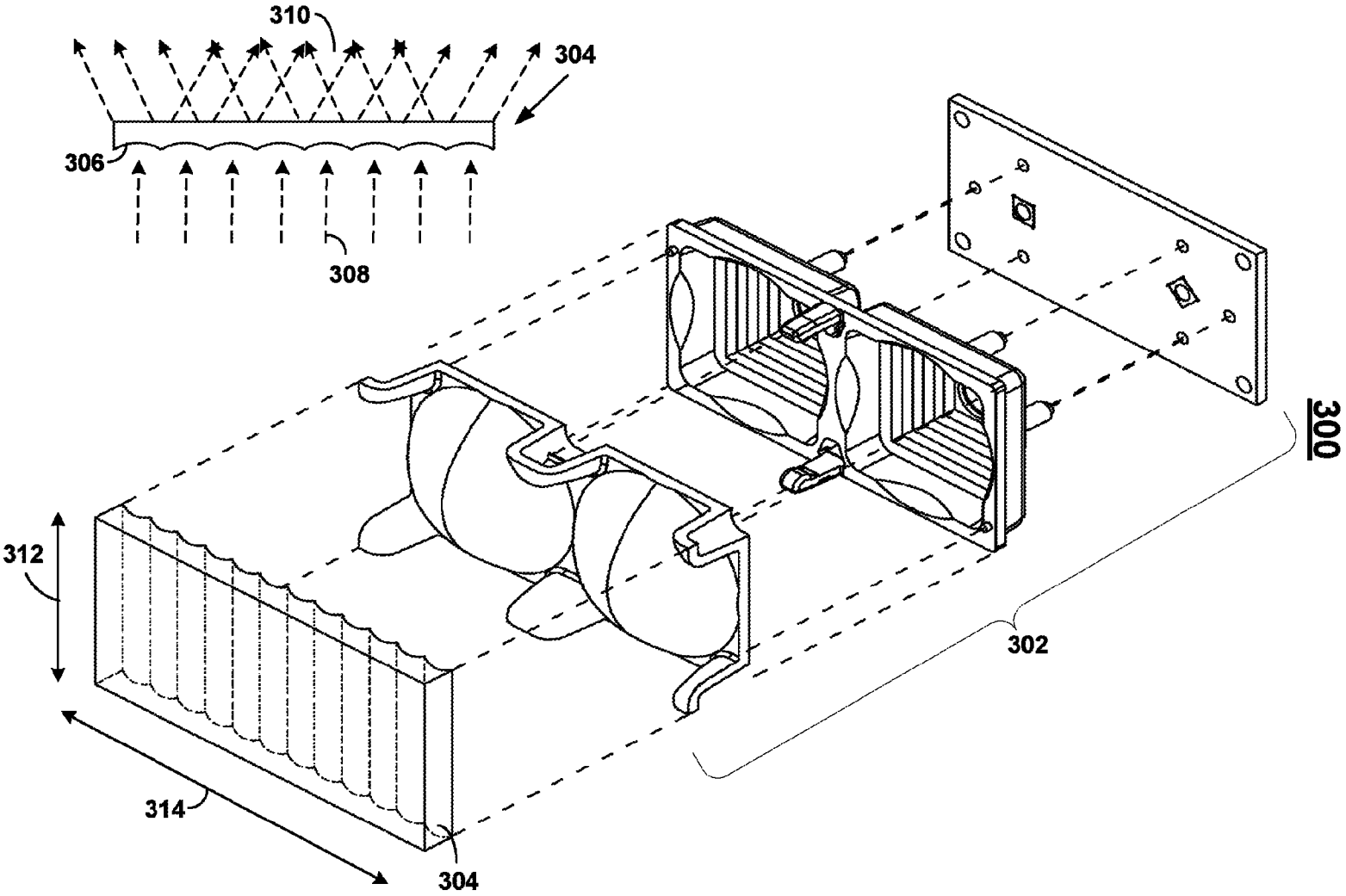
FIG. 3 illustrates an alternate light collection and projection system in accordance with one embodiment of the present invention.

Turning to FIG. 3, an exploded view of light collection and projection system 300 is exemplified, which may include a collection and projection system (e.g., two-LED collection and projection system 302) and diffuser 304. Diffuser 304 may, for example, also function as a plate of an LED-based lighting fixture (e.g., transparent plate 104 of FIG. 1). Conversely, the LED-based lighting fixture may include a separate plate (not shown), whereby diffuser 304 may be temporarily or permanently attached to the plate.

As an example, diffuser 304 may exhibit scalloped structure 306, where each scallop may exhibit an arc (e.g., a 45 degree arc) that may run the entire width 312 of diffuser 304. In operation, diffuser 304 may receive a controlled beam of light having a specified target illuminance (e.g., spot beam 308) as may be projected by LED-based lighting system 302. Diffuser 304 may, for example, spread the light projected by spot beam 308 into diffused beam 310, whereby spot beam 308 may be transformed into a secondary target illuminance that may conform to standards as promulgated, for example, by the Department of Transportation or the Economic Commission for Europe. In such an instance, for example, diffused beam 310 may be compatible for use as a head light in automotive applications.

An additional diffuser (not shown) may be superimposed upon diffuser 304 to diffuse light along a different axis than light diffused by diffuser 304. For example, the additional diffuser may exhibit a scalloped structure, where each scallop may exhibit an arc that may run the entire length 314 of the additional diffuser. In operation, the additional diffuser may receive a controlled beam of light having a specified target illuminance (e.g., diffused beam 310). The additional diffuser may, for example, spread diffused beam 310 into a different diffused beam, whereby diffused beam 310 may be transformed into a tertiary target illuminance (e.g., multiple directions of light at differing intensities).

It should be noted that any types and/or combinations of diffusers may be utilized with light collection and projection system 302. Bulk/die additive diffusers may be utilized, for example, whereby inks, dies or other light-absorbing chemicals may be added to the diffuser substrate to create a combination of intensity, reflection, refraction and/or diffraction. Holographic diffusers may, for example, include surface structures of various shapes to diffract light in accordance with a particular application. Volumetric diffusers may, for example, be utilized that suspend particles within the diffuser substrate to guide light through refraction in a controlled fashion.

For example, two 20-degree diffusers superimposed on each other and aligned along the same axis may provide the same target illuminance of a single 45-degree diffuser. As per another example, two diffusers superimposed on each other and aligned along orthogonal axes may combine to form a symmetrical flood beam when diffusing a collected light source (e.g., spot beam 308).

Figure 4:
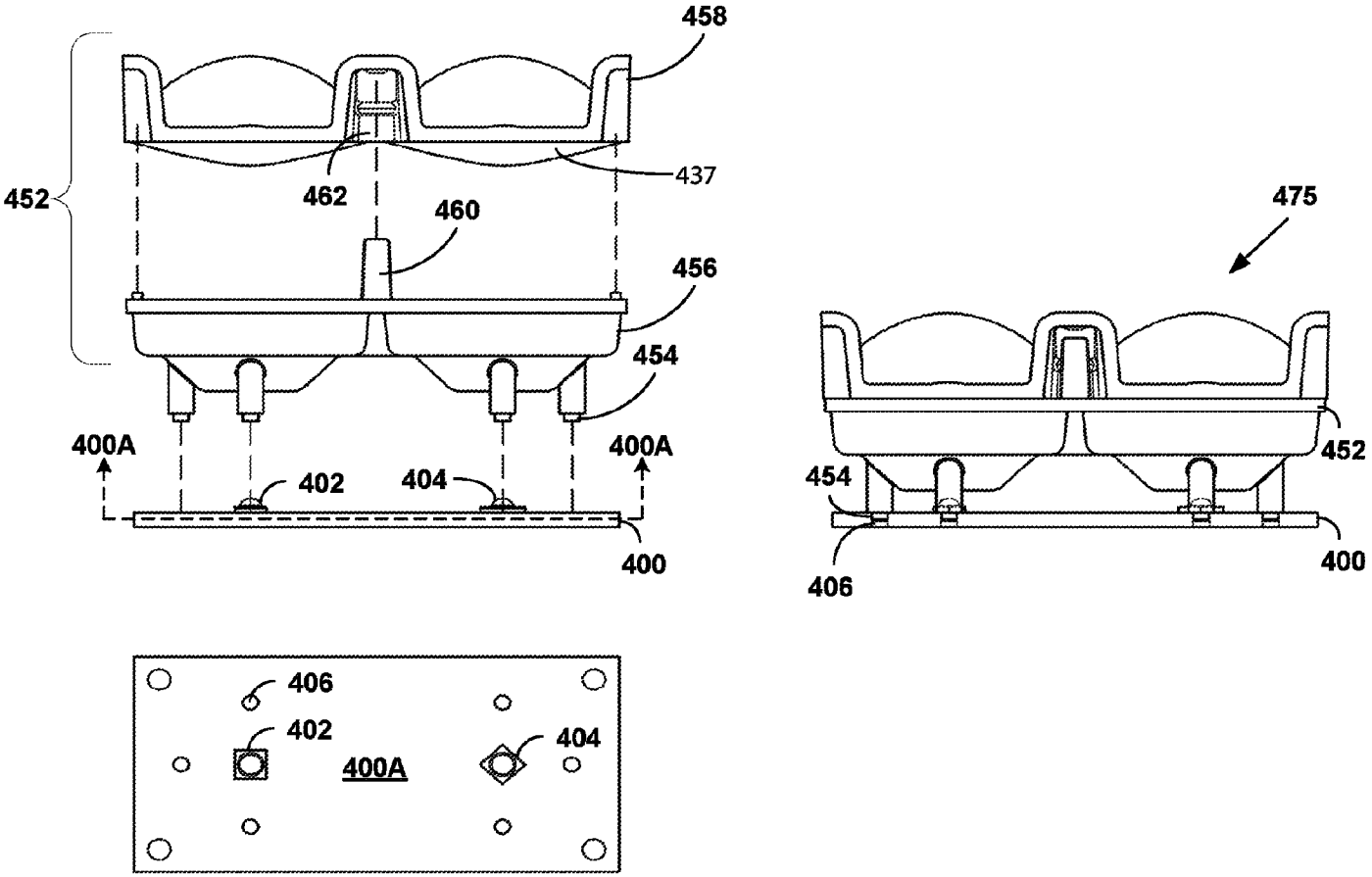
FIG. 4 illustrates side and plan views of a light collection and projection system in accordance with one embodiment of the present invention.

Turning to FIG. 4, various plan and side views of a light collection and projection system are exemplified. PCB 400, for example, is illustrated in plan view 400A to exemplify placement of LEDs 402 and 404 relative to one another. LED 402, for example, may exhibit an orientation as shown and LED 404 may exhibit an orientation that is rotated with respect to LED 402. As per an example, LED 404 may be rotated (e.g., rotated by 45 degrees) with respect to the orientation of LED 402.

Light collection and projection systems exhibiting a number of LEDs greater than two may exhibit similar LED orientations that may be dependent upon the specific number of LEDs being utilized. For example, a light collection and projection system utilizing three LEDs, may rotate the placement of each LED by 30 degrees with respect to one another. As per another example, a light collection and projection system utilizing four LEDs, may rotate the placement of each LED by 22.5 degrees with respect to one another. In general, the specific rotation exhibited by each LED may be calculated by equation (1) as:

$$R=90/N, \tag{1}$$

where N is the number of LEDs utilized in a light collection and projection system and R is the rotation offset in degrees that may by exhibited by each LED. Accordingly, for example, a light collection and projection system utilizing six LEDs may exhibit LEDs that are rotated by 15 degrees with respect to one another.

PCB 400 may, for example, utilize mechanical indexing features (e.g., holes 406) that may be configured to accept the mechanical indexing features (e.g., feet 454) of a component (e.g., carrier 456) to engage carrier 456 to PCB 400. Carrier 456 may further be engaged to lens 458 to form a carrier/lens combination, whereby a locking mechanism (e.g., friction-based, male locking mechanism 460) may engage a corresponding locking mechanism (e.g., friction-based, female locking mechanism 462) to form carrier/lens combination 452.

Light collection and projection system 475 may include PCB 400 and carrier/lens combination 452. As illustrated, one or more mechanical indexing features 406 may engage corresponding mechanical indexing features 454 of carrier/lens combination 452 to form light collection and projection system 475. Light collection and projection system 475 may then be integrated within an LED-based lighting fixture (e.g., LED-based lighting fixture 100 of FIG. 1).

Figure 5:
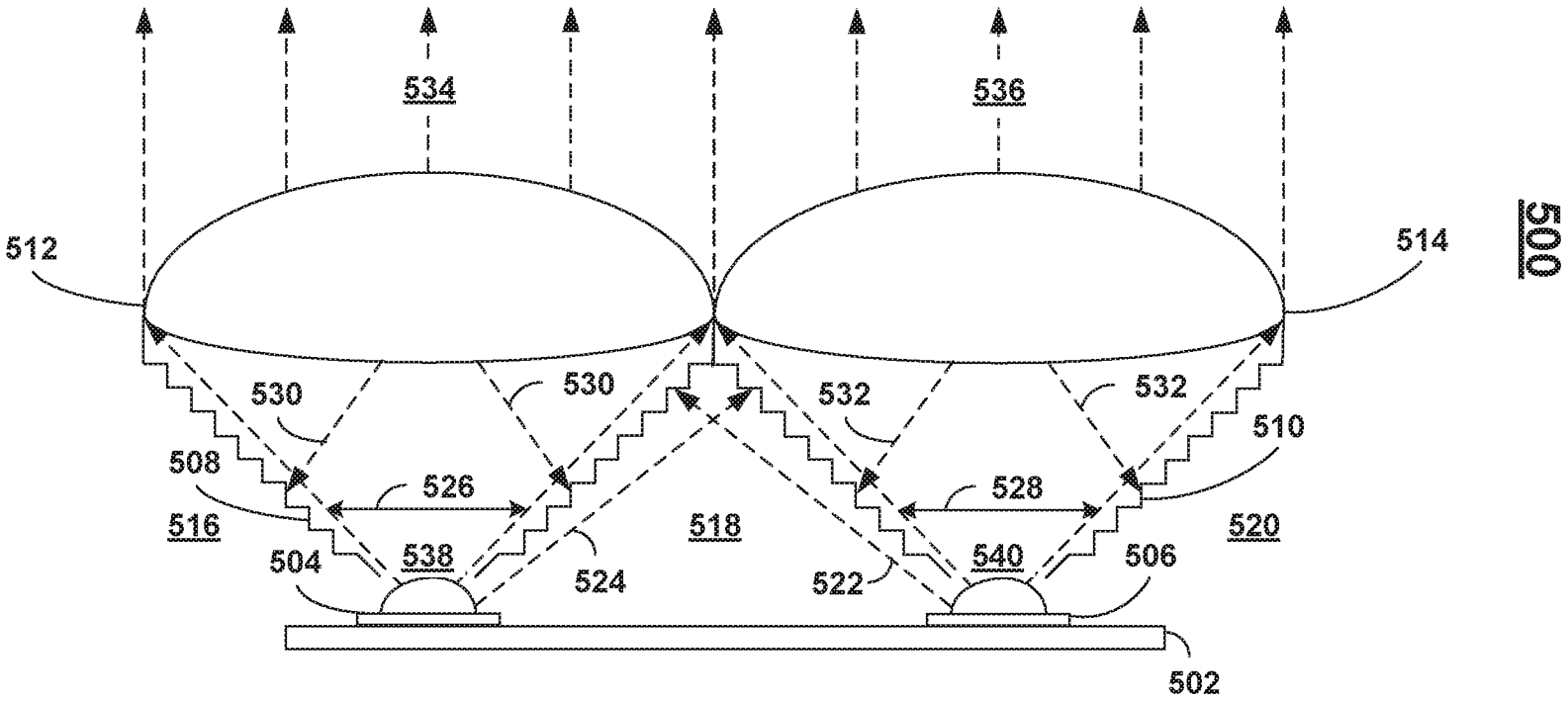
FIG. 5 illustrates a photometric diagram of a side view of a light collection and projection system in accordance with one embodiment of the present invention.

Turning to FIG. 5, a photometric diagram of a side view of a light collection and projection system is exemplified.

Multiple LEDs (e.g., LEDs 504 and 506) may, for example, be mounted to PCB 502 along with bias and control circuitry (not shown) to illuminate LEDs 504 and 506 on command. The photometric distribution of LEDs 504 and 506 may, however, be such that light emitted from LED 504 may be received by lens 514 (e.g., interference light 524) and conversely, light emitted from LED 506 may be received by lens 512 (e.g., interference light 522). Accordingly, carrier 508 may be employed to block interference light 522 from entering lens 512 and carrier 510 may be employed to block interference light 524 from entering lens 514. Carrier 508 may further be employed to mechanically engage lens 512 to maintain an optimal geometric relationship between lens 512 and LED 504 and carrier 510 may further be employed to mechanically engage lens 514 to maintain an optimal geometric relationship between lens 514 and LED 506.

Carrier 508 may, for example, exhibit aperture 538 having a flanged, or angled, portion to allow light emanated from LED 504 (e.g., light having spread 526) to be passed on to lens 512. As can be seen, photometric distribution from LED 504 that extends outside of carrier 508 may not pass to lens 512, nor may it pass to lens 514 due to the blocking operation of carrier 510. Similarly, carrier 510 may, for example, exhibit aperture 540 having a flanged, or angled, portion to allow light emanated from LED 506 (e.g., light having spread 528) to be passed on to lens 514. As can be seen, photometric distribution from LED 506 that extends outside of carrier 510 may not pass to lens 514, nor may it pass to lens 512 due to the blocking operation of carrier 508.

Carrier 508 may, for example, exhibit hard optical angles (e.g., a stair-stepped surface having sharp corners or a stair-stepped surface having rounded corners) such that any light incident on the stair-stepped surface (e.g., light 530) may be reflected, if at all, away from lens 512. In addition, carrier 508 may exhibit a non-reflective color (e.g., black) so as to further increase absorption of light 530. Further, carrier 508 may exhibit a non-reflective texture (e.g., a coarse texture) so as to further increase absorption of light 530. Similarly, carrier 510 may, for example, exhibit hard optical angles (e.g., a stair-stepped surface having sharp corners or a stair-stepped surface having rounded corners) such that any light incident on the stair-stepped surface (e.g., light 532) may be reflected, if at all, away from lens 514. In addition, carrier 510 may exhibit a non-reflective color (e.g., black) so as to further increase absorption of light 532. Further, carrier 510 may exhibit a non-reflective texture (e.g., a coarse texture) so as to further increase absorption of light 532.

Light emanated from lens 512 (e.g., light 534) may, therefore, result from only that light emitted by LED 504 that falls within the photometric distribution as defined by aperture 538 of carrier 508. In addition, any light emitted by LED 506 is not permitted to enter lens 512 by virtue of carrier 508. Similarly, light emanated from lens 514 (e.g., light 536) may, therefore, result from only that light emitted by LED 506 that falls within the photometric distribution as defined by aperture 540 of carrier 510. In addition, any light emitted by LED 504 is not permitted to enter lens 514 by virtue of carrier 510.

Accordingly, for example, light emitted by each lens of an LED-based lighting system may be based almost entirely on the light emitted by the LED that is associated with that particular lens due to the shape, color, texture and other characteristics of the carrier that supports the lens. In so doing, a specified target illuminance (e.g., a spot beam pattern) may be provided by each lens of an LED-based lighting system that is substantially free from spill light or otherwise uncontrolled light.

Figure 6:
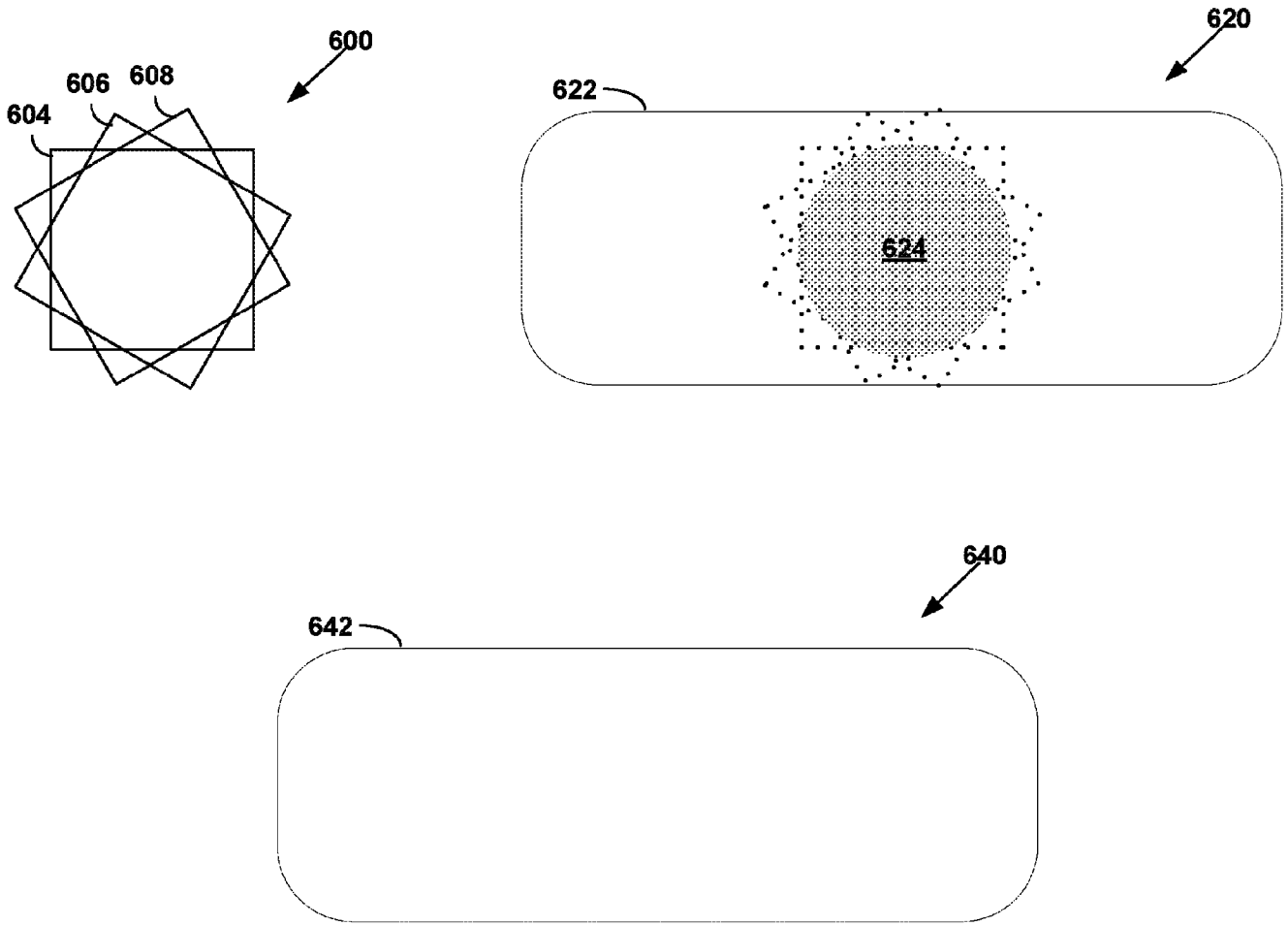
FIG. 6 illustrates light projection diagrams of various light collection and projection systems in accordance with various embodiments of the present invention.

Turning to FIG. 6, light projection diagrams are exemplified. Light projection diagram 600 may, for example, represent the specified target illuminance delivered by an LED-based lighting system having multiple (e.g., three) LEDs. A first beam pattern (e.g., beam pattern 604) may, for example, represent the specified target illuminance as provided by a first LED/carrier/lens combination. Second and third beam patterns (e.g., beam patterns 606 and 608) may, for example, represent the specified target illuminance delivered by second and third LEDs of an LED-based lighting system. As can be seen, each beam pattern may be rotated with respect to each of the other beam patterns by virtue of the rotation of each LED (e.g., as described in relation to FIG. 4) of the LED-based lighting system.

As per an example, beam patterns 604-608, as may be generated by a three-LED lighting system, may be rotated by 30 degrees with respect to each other as may be calculated from equation (1). In other words, for example, a substantially square beam pattern may be generated by each LED of an LED-based lighting system and the phase rotation of each beam pattern may be substantially equivalent to the phase rotation of each LED as mounted to its respective PCB. Accordingly, due to the rotation of beam patterns 604-608, any disturbances and/or imperfections that may exist within each of the beam patterns 604-608 individually may tend to be blended together (e.g., averaged).

Light projection diagram 620 may, for example, represent an alternate target illuminance that may be generated by first collecting the light into a specified target illuminance (e.g., spot beam patterns 604-608) and then partially diffusing the specified target illuminance into a broader beam pattern (e.g., beam pattern 622). Partial diffusion may result, for example, when the target illuminance from portions of one or more LED/carrier/lens combinations is diffused while the target illuminance from portions of the remaining LED/carrier/lens combinations is not diffused. Since spot beam patterns 604-608 are partially diffused, a concentration of light (e.g., concentration 624) may exist at a center portion of beam pattern 622, while the remaining light may be diffused across a broader beam pattern (e.g., beam pattern 622).

Light projection diagram 640 may, for example, represent an alternate target illuminance that may be generated by first collecting the light into a specified target illuminance (e.g., spot beam patterns 604-608) and then fully diffusing the specified target illuminance into a broader beam pattern (e.g., beam pattern 642). Full diffusion may result, for example, when the target illuminance from all LED/carrier/lens combinations is diffused (e.g., as illustrated in FIG. 3). Since spot beam patterns 604-608 are being fully diffused, a beam pattern substantially free from a concentration of light within the middle of the beam pattern (e.g., beam pattern 642) may result. Beam pattern 620 and 640 may, for example, be compliant with beam pattern standards as may be promulgated by the Department of Transportation or the Economic Commission for Europe.

Figure 7:
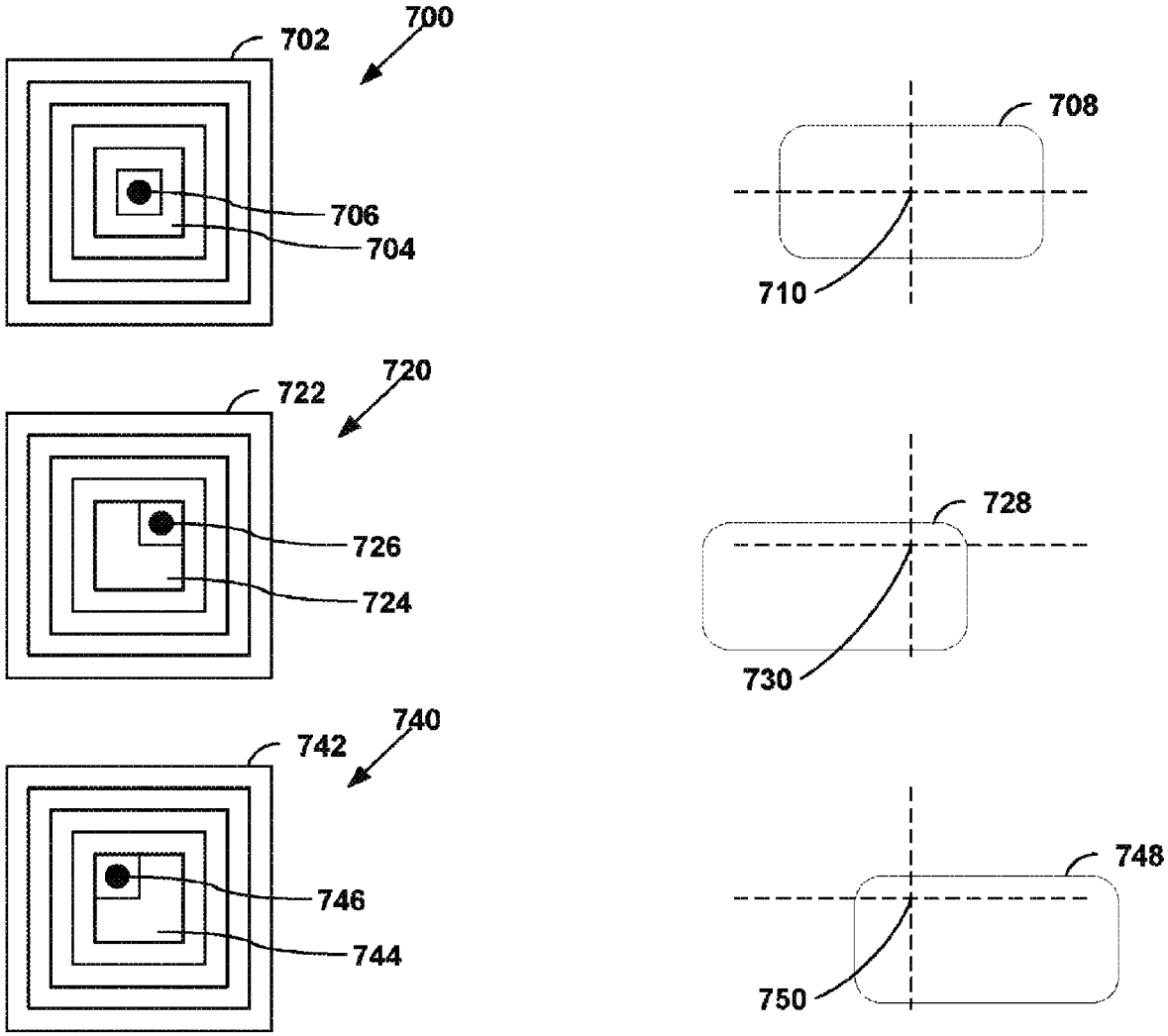
FIG. 7 illustrates geometric relationships between an LED and an associated carrier and resulting light projections in accordance with various embodiments of the present invention.

Turning to FIG. 7, illustrations 700, 720 and 740 exemplify variations in LED placement within the aperture of a carrier from a plan view perspective. Looking down into the bowl of carrier 702 of illustration 700, for example, it can be seen that LED 706 may be centered within aperture 704 as illustrated. The resulting target illuminance (e.g., as may be projected by LED 706, carrier 702, and an associated lens/diffuser combination) may be depicted by light projection 708, which may be substantially centered along an optical axis (e.g., optical axis 710 of LED 706) as shown.

Alternately, LED 726 may be offset within aperture 724 per illustration 720, where it can be seen that LED 726 may be offset to the upper right-hand corner within aperture 724 as illustrated. The resulting target illuminance (e.g., as may be projected by LED 726, carrier 722, and an associated lens/diffuser combination) may be depicted by light projection 728, which may be offset below and to the left of optical axis 730 as shown. In general, as LED 726 moves upward and toward the right relative to aperture 724, light projection 728 may be inverted and may, therefore, move downward and toward the left relative to optical axis 728.

Alternately, LED 746 may be offset within aperture 744 per illustration 740, where it can be seen that LED 746 may be offset to the upper left-hand corner within aperture 744 as illustrated. The resulting target illuminance (e.g., as may be projected by LED 746, carrier 742, and an associated lens/diffuser combination) may be depicted by light projection 748, which may be offset below and to the right of optical axis 750 as shown. In general, as LED 746 moves upward and toward the left relative to aperture 744, light projection 748 may be inverted and may, therefore, move downward and toward the right relative to optical axis 748.

Figure 8:
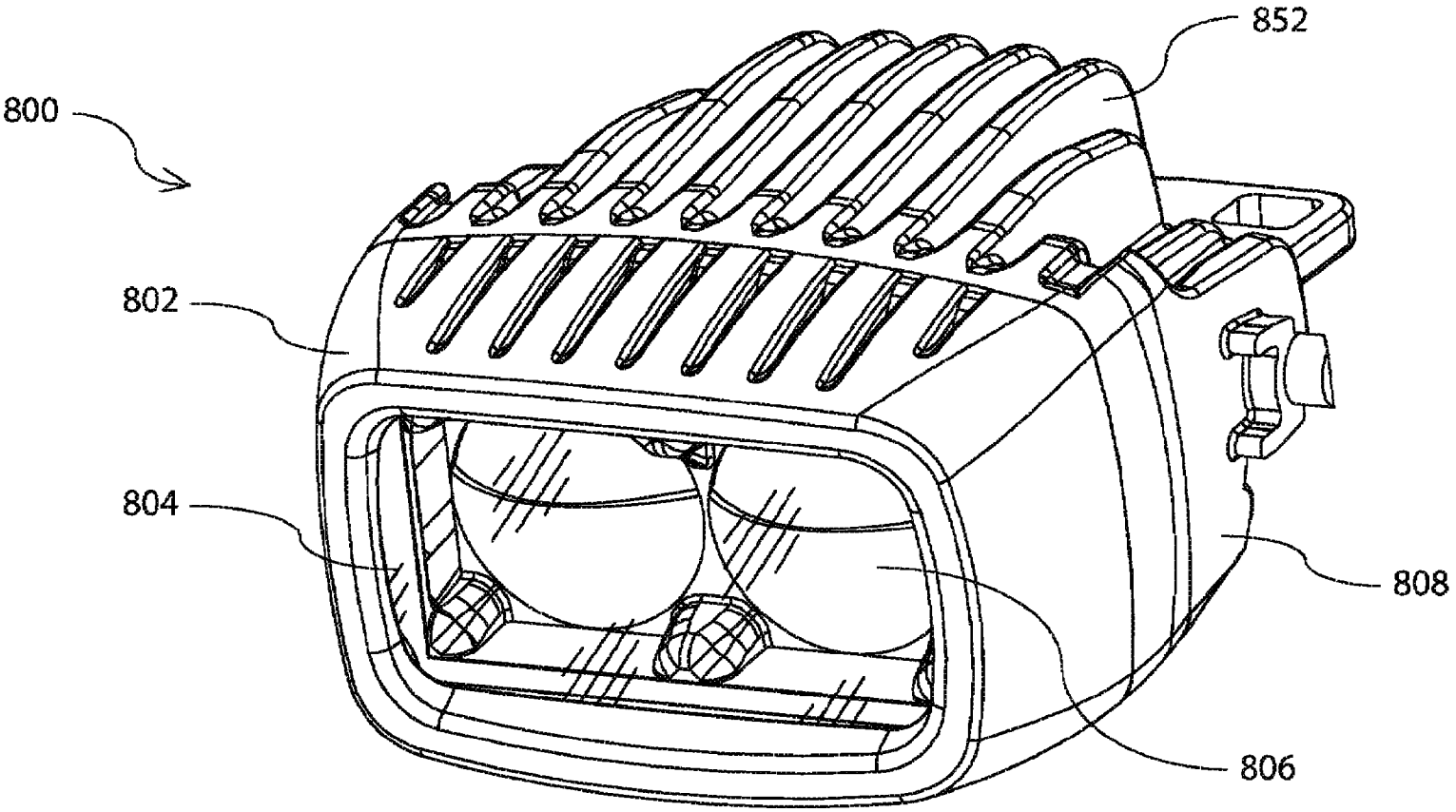
FIG. 8 illustrates an LED-based lighting fixture in accordance with another embodiment of the present invention.

Turning to FIG. 8, an exemplary LED-based lighting fixture 800 is illustrated, which may include a bezel 802 and a body portion 808 with heat sink fins 852 extending from body portion 808. Bezel 802 may, for example, enclose one or more lenses 806, a plate (e.g., transparent plate 804), and a PCBA (not shown) positioned against body portion 808. Lenses 806 may be retained against transparent plate 804 by one or more carriers (not shown) extending from the PCBA. The PCBA may include one or more LEDs (not shown) and control circuitry (not shown) to enable regulation of power provided to the one or more LEDs. Transparent plate 804 may be sealed to bezel 802 (e.g., via a first gasket), and bezel 802 may be sealed to body portion 808 (e.g., via a second gasket), such that an interior of bezel 802 may house the PCBA, the carrier, lenses 806, and transparent plate 804, and such that the interior of bezel 802 may be sealed from moisture and/or other particulates.

In addition to the bi-convex, plano-convex, equi-convex, and Fresnel lens configurations previously described, it should be noted that lenses 806 may include a bi-focal and/or a multi-focal configuration (e.g., 3 or more foci). Furthermore, the bi- and/or multi-focal configuration may coexist with one or more of the bi-convex, plano-convex, equi-convex, and Fresnel lens configurations. For example, a bi-convex lens configuration may also include a bi-focal configuration. In another example, a Fresnel lens configuration may also include a multi-focal configuration. A person of ordinary skill in the art will appreciate that many more combined configurations are possible beyond those specifically discussed herein.

Figure 9:
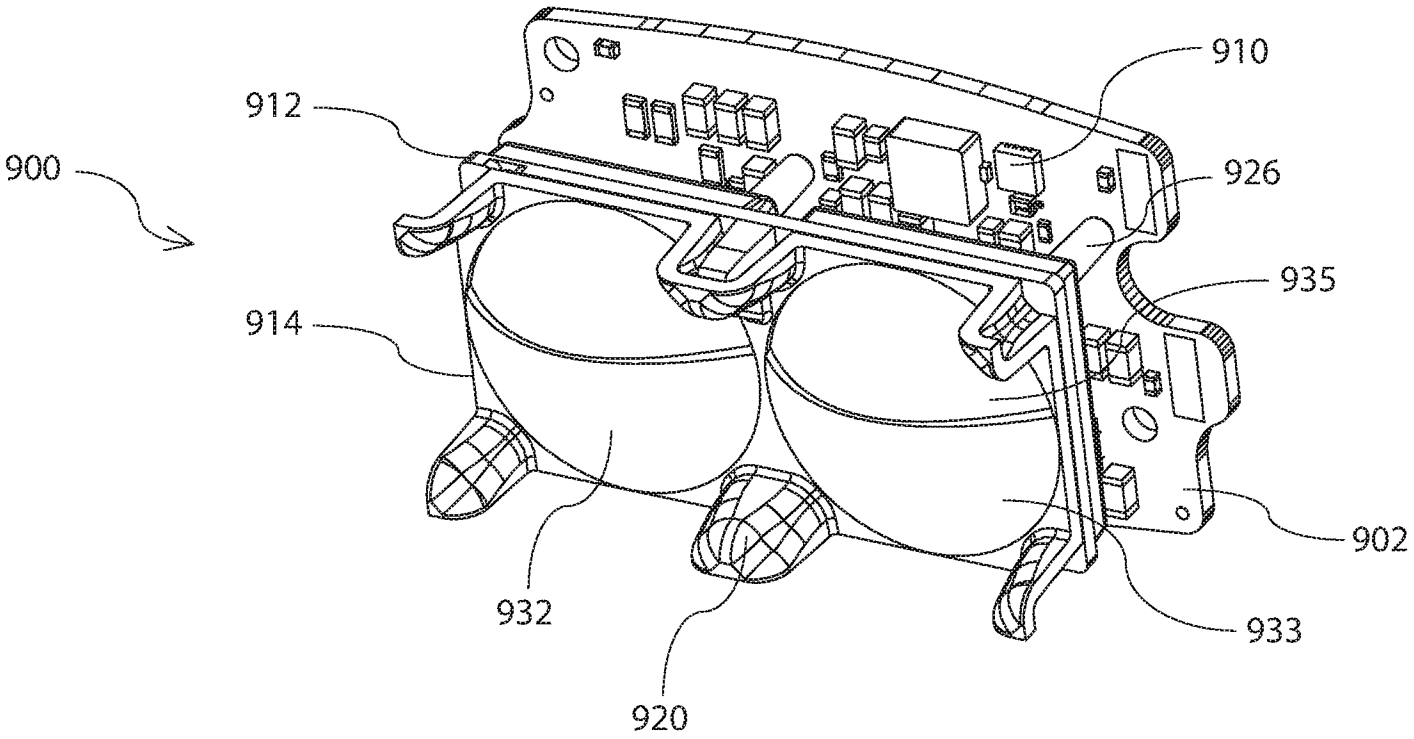
FIG. 9 illustrates a light collection and projection system in accordance with another embodiment of the present invention.

Turning to FIG. 9, a light collection and projection system 900 is exemplified, which may include a PCBA 902 including one or more LEDs (not shown) and associated bias and control circuitry 910 mounted thereon. Light collection and projection system 900 may further include a lens structure 914 and a carrier 912 that may include one or more bowl portions (not shown) positioned to receive lens structure 914.

Lens structure 914 may be positioned in an optimized geometric relationship with respect to PCBA 902. For example, carrier 912 may include one or more extension portions (e.g., legs 926) which may interconnect with PCBA 902 to achieve only a single geometric relationship (e.g., the optimized geometric relationship). Further, the one or more extension portions (e.g., legs 926) may be dimensioned with a predetermined span to achieve an optimized separation distance between lens structure 914 and the LEDs of PCBA 902 and/or to achieve an optimized separation distance between a bottom portion of carrier 912 (e.g., rearward surface 1622 of FIG. 16) and the LEDs of PCBA 902 (e.g., forward portion 1605 of FIG. 16). Such an optimized separation distance may, for example, facilitate a predetermined portion of the photometric distribution of the LEDs to be collected and passed through lens structure 914 and/or may prohibit a predetermined portion of the photometric distribution of the LEDs from being collected and passing through lens structure 914.

The one or more bowls of carrier 912 may be shaped to enable and/or prohibit the predetermined portion of the photometric distribution of the LEDs to be collected and passed through lens structure 914. Furthermore, carrier 912 may exhibit a non-reflective color (e.g., black) and/or a non-reflective texture (e.g., a coarse texture) so as to be substantially non-reflective of any light that may be incident on carrier 912.

Lens structure 914 may include one or more lenses 932 for subtending light emitted by the LEDs of the PCBA 902. As exemplified in FIG. 9, lens structure 914 may include two lenses 932. Alternately, a lens structure may include more than two lenses 932 (e.g., 3, 4, 5, 6, or more lenses). Lens structure 914 may include one or more extensions 920, which may engage portions of an LED-based lighting fixture (e.g., transparent plate 804 of FIG. 8).

The predetermined portion of the photometric distribution of the LEDs may be collected and passed through discrete regions of the one or more lenses 932 (e.g., where the number of regions may correspond to a number of foci of each lens 932). For example, a bi-focal lens (e.g., lens 932) may have two discrete regions (e.g., first and second regions 933, 935), each region having a focus. In another example, a multi-focal lens may have three or more discrete regions, each region having a focus. In the above examples, the focus of each region may be the same as or different from the focus of one or more of the other regions.

Figure 10:
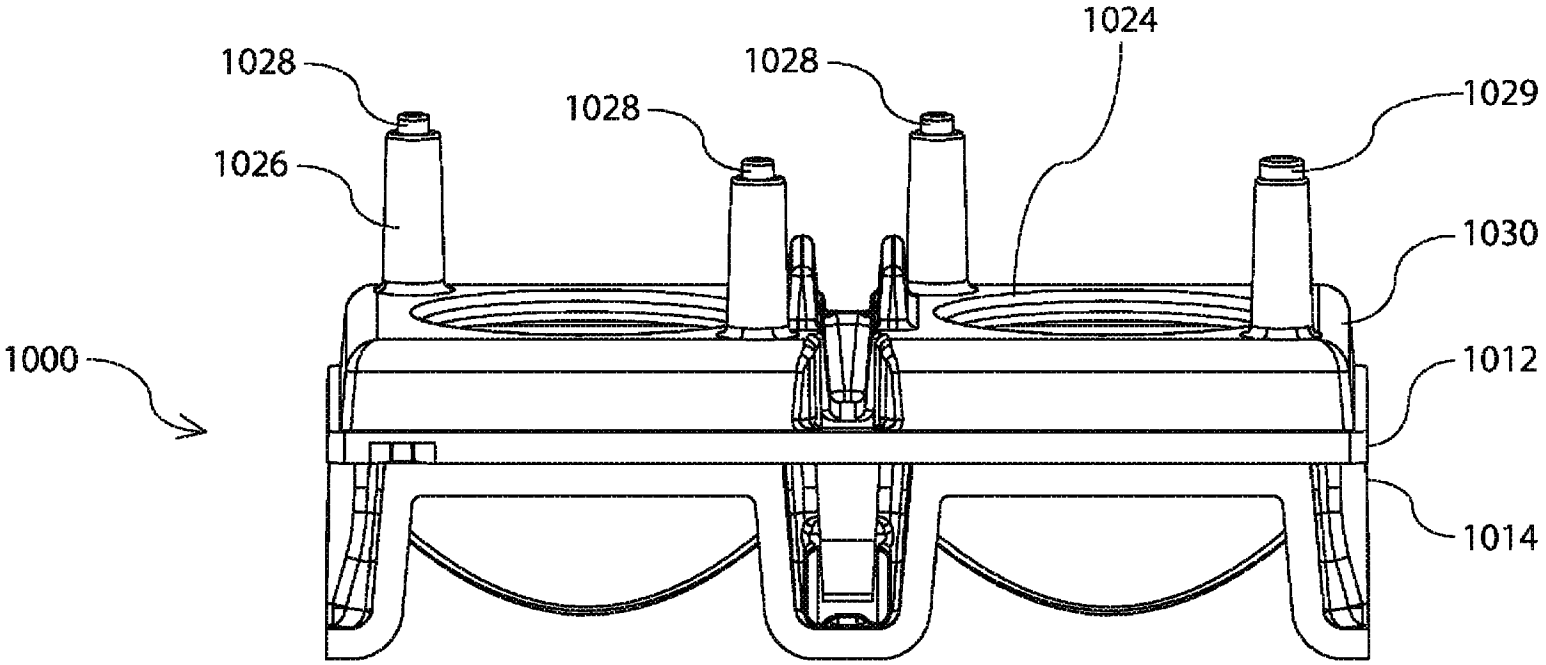
FIG. 10 illustrates a light collection and projection system in accordance with another embodiment of the present invention.

Turning to FIG. 10, a light collection and projection system 1000 is exemplified, which may include a lens structure 1014 and a carrier 1012 that may include one or more bowl portion 1030 positioned to receive lens structure 1014. Each bowl portion 1030 may have an aperture 1024 extending through the bowl portion 1030 and one or more extension portions (e.g., legs 1026) extending from the bowl portion 1030 to facilitate in collection and/or exclusion of a predetermined portion of the photometric distribution from one or more LEDs (e.g., LEDs 402, 404 of FIG. 4) on a PCBA (e.g., PCBA 400 of FIG. 4). For example, aperture 1024 and legs 1026 may be positioned oppositely of the lens structure 1014. In another example, legs 1026 may be dimensioned to create an optimized separation distance between a portion of the LEDs (e.g., bottom portion 1608 of FIG. 16) and one or more of lens structure 1014 and/or carrier 1012. In another example, each bowl portion 1030 may have two or more legs 1026.

The one or more extension portions (e.g., legs 1026) may each have a mechanical indexing feature (e.g., feet 1028, 1029) for interfacing with a corresponding mechanical indexing feature (e.g., holes 406 of FIG. 4) of the PCBA. Each of the mechanical indexing features may be similarly dimensioned, except that at least one mechanical indexing feature (e.g., foot 1029) may be dimensioned differently from every other mechanical indexing feature, and this difference in dimension may correspond to a differently dimensioned mechanical indexing feature of the PCBA. For example, foot 1029 may ensure that carrier 1012 is interconnected with the PCBA in an optimal geometric relationship (e.g., right side up). In another example, foot 1029 may have a larger dimension than feet 1028. A person skilled in the art will appreciate that additional configurations and dimensions may be possible to facilitate an optimal geometric relationship.

Figure 11:
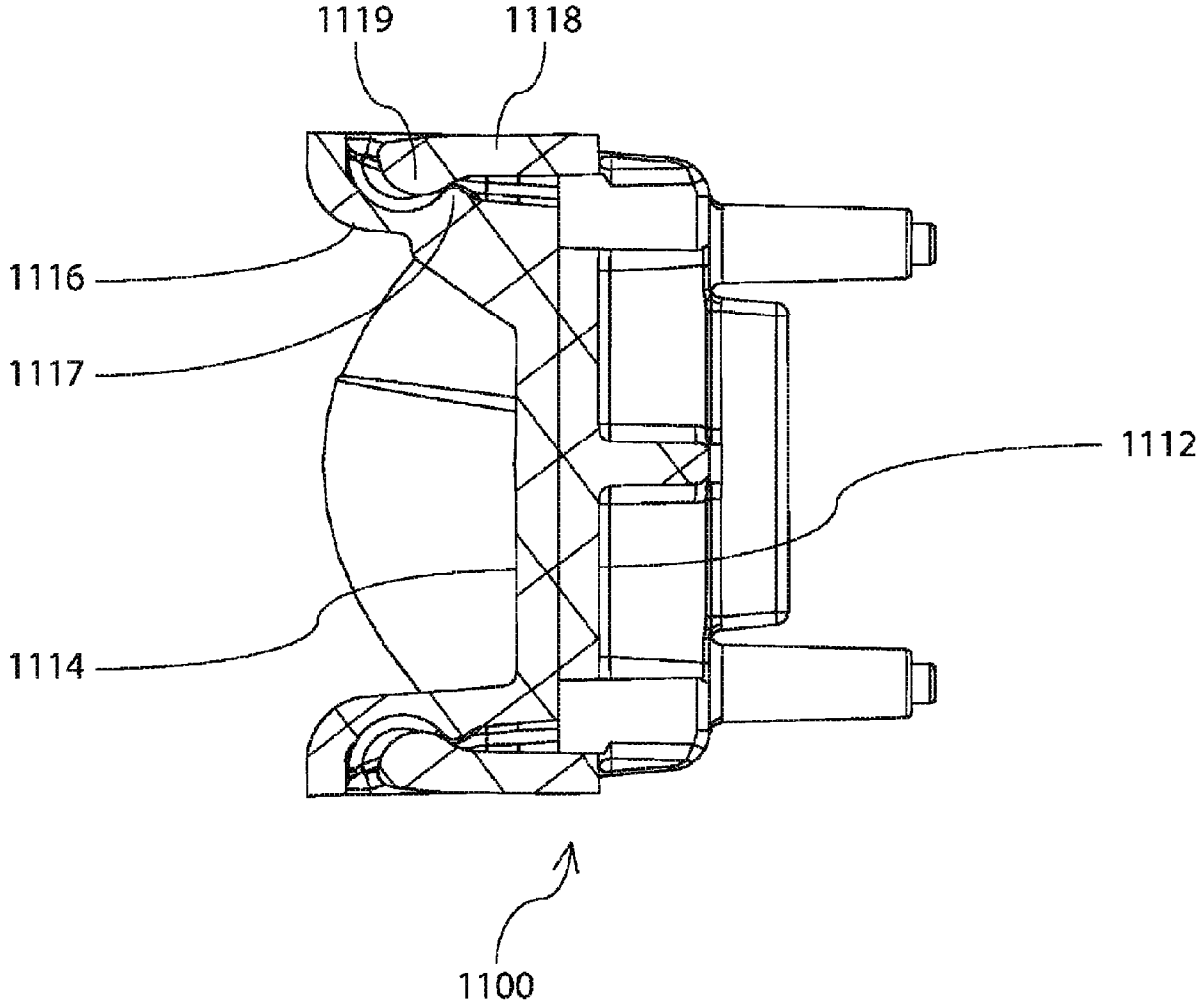
FIG. 11 illustrates a cross-sectional view of the light collection and projection system of FIG. 10.

Turning to FIG. 11, a cross-section of a light collection and projection system 1100 is exemplified, which may include a lens structure 1114 in alignment with and/or affixed to a carrier 1112. For example, lens structure 1114 may be removably fixed to carrier 1112 (e.g., via corresponding friction-based locking mechanisms). In another example, lens structure 1114 may be permanently fixed to carrier 1112 (e.g., via adhesive). In another example, lens structure 1114 may be affixed to carrier 1112 by both corresponding friction-based locking mechanisms and adhesive.

Carrier 1112 may include one or more locking mechanisms (e.g., friction-based male locking mechanisms 1118) which may be configured to interconnect with corresponding locking mechanisms (e.g., friction-based female locking mechanisms 1116) of lens structure 1114. Further, one or more of the friction-based male locking mechanisms may include a bulb 1119, and one or more of the friction-based female locking mechanisms may include a rib 1117, such that upon interconnection and/or disconnection bulb 1119 passes across rib 1117. Accordingly, friction-based male locking mechanisms 1118 may be capable of enough deflection to allow bulb 1119 to pass over rib 1117.

For example, upon interconnection, friction-based male locking mechanisms 1118 may begin in an undeflected position, may deflect to a maximum deflection position when bulb 1119 passes across rib 1117, and may return to their undeflected positions. In another example, upon interconnection, friction-based male locking mechanisms 1118 may begin in an undeflected position, may deflect to a maximum deflection position when bulb 1119 passes across rib 1117, and may deflect to an intermediate position between the undeflected position and the maximum deflection position.

In either of the above examples, lens structure 1114 may be attached (e.g., removably attached) to carrier 1112 by the engagement of one or more friction-based male locking mechanisms 1118 with one or more friction-based female locking mechanisms 1116. The attachment may be facilitated by an interference (e.g., frictional) fit between the male and female locking mechanisms and/or by a torsional clamping which occurs between at least two opposing male locking mechanisms (e.g., as exemplified in FIG. 11). While the bulb 1119 and rib 1117 of the male and female locking mechanisms, respectively, have been illustrated with smoothly shaped contours (e.g., capable of removable attachment), a person of ordinary skill in the art will appreciate that other shaped contours may be employed to achieve different modes of attachment (e.g., permanent attachment).

Figure 12A:
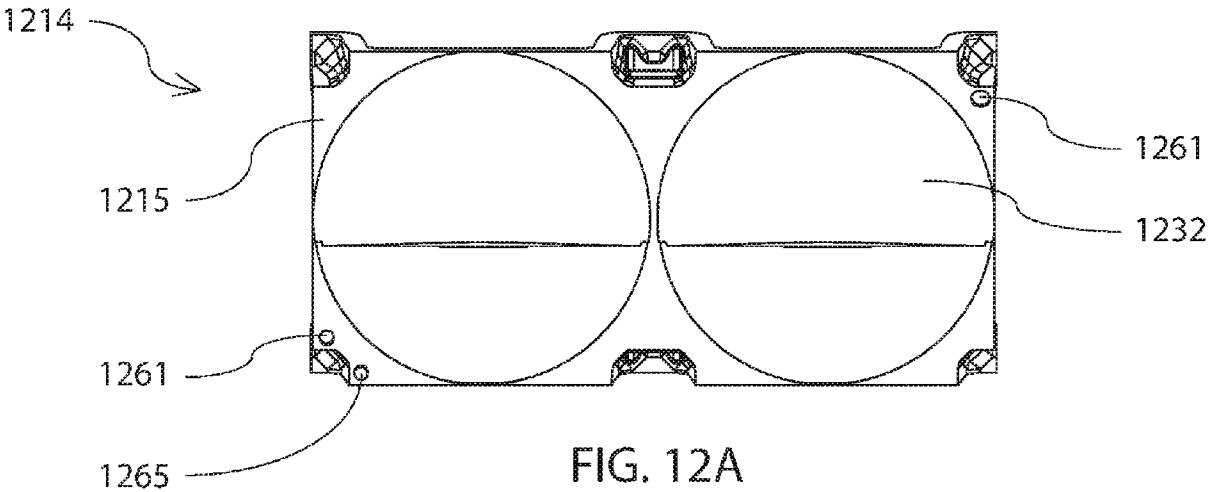
FIG. 12A illustrates a back side view of a lens structure for attachment with a front side of a carrier.
Figure 12B:
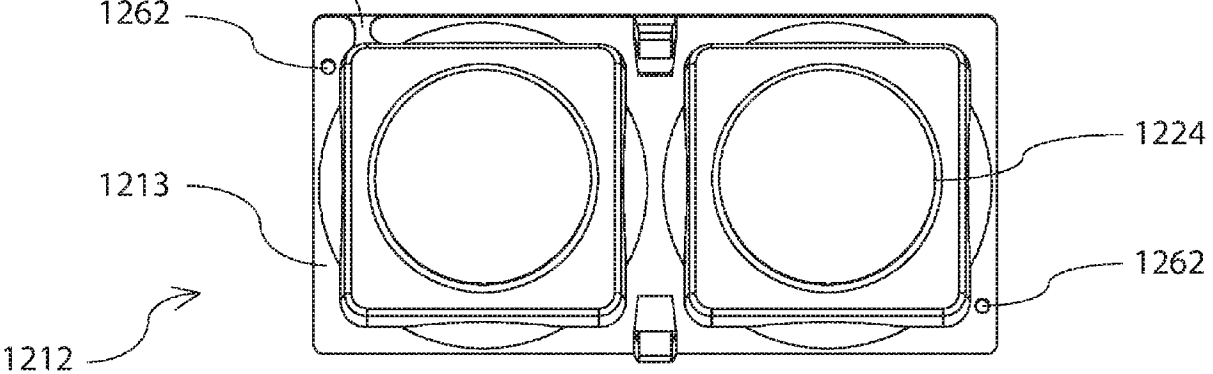
FIG. 12B illustrates a front side view of a carrier for attachment with a back side of a lens structure.

Turning to FIGS. 12A and 12B, FIG. 12A illustrates a back side 1215 of a lens structure 1214 which may be capable of interconnection with a front side 1213 of a carrier 1212 as illustrated in FIG. 12B. Upon interconnection, lens structure 1214 and carrier 1212 may form a light collection and projection system (e.g., light collection and projection system 1100 of FIG. 11).

Lens structure 1214 may have one or more mechanical indexing features (e.g., holes 1261 and/or pegs 1265) for interfacing with a corresponding mechanical indexing feature (e.g., pegs 1262 and/or slot 1266) of carrier 1212. The mechanical indexing features of lens structure 1214 may be particularly suited to facilitate interconnection with the mechanical indexing features of carrier 1212 in an optimized geometric relationship.

For example, pegs 1262 may be capable of interconnection with holes 1261 in order to align lens structure 1214 with carrier 1212 (e.g., such that each lens 1232 is centered over a corresponding aperture 1224). In another example, a single peg 1265 may be capable of interconnection with a single slot 1266 in order to ensure that lens structure 1214 may interconnect with carrier 1212 in only a single configuration (e.g., the optimized geometric relationship). A person of ordinary skill in the art will appreciate that other configurations may be possible to achieve the optimized geometric relationship.

Figure 13:
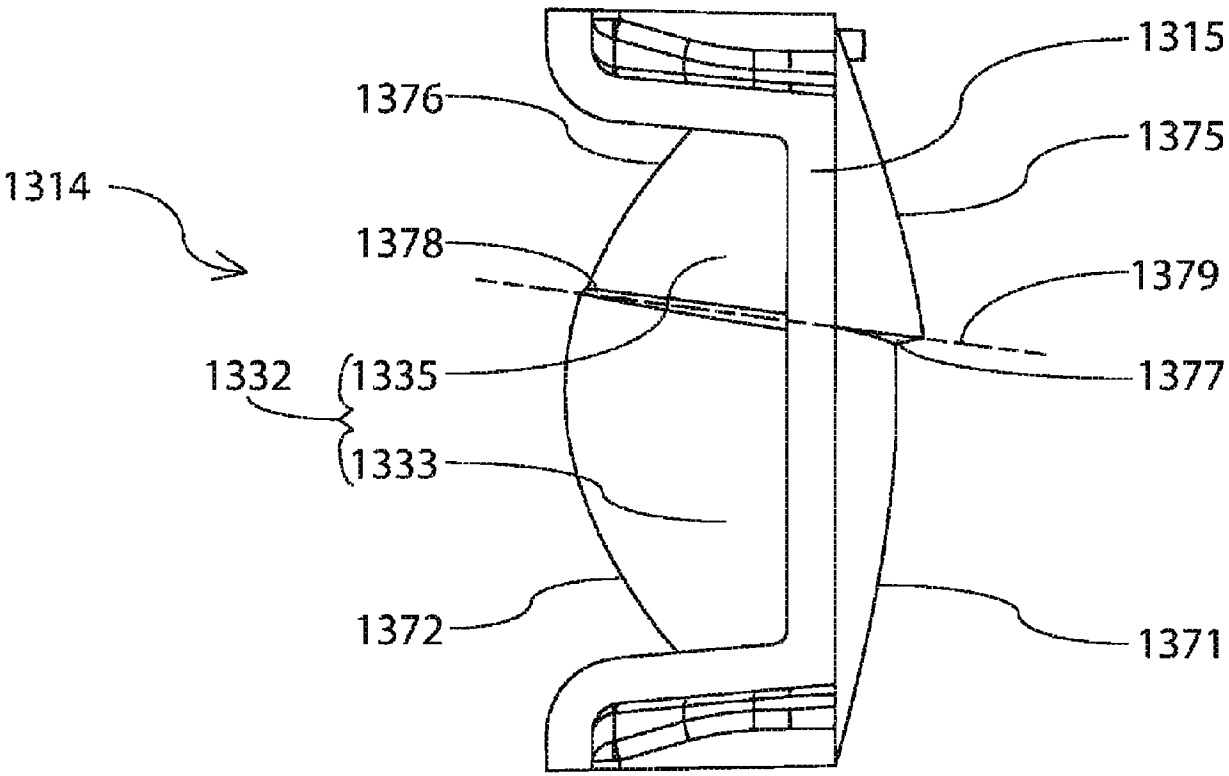
FIG. 13 illustrates a side view of a lens structure.
Figure 14:
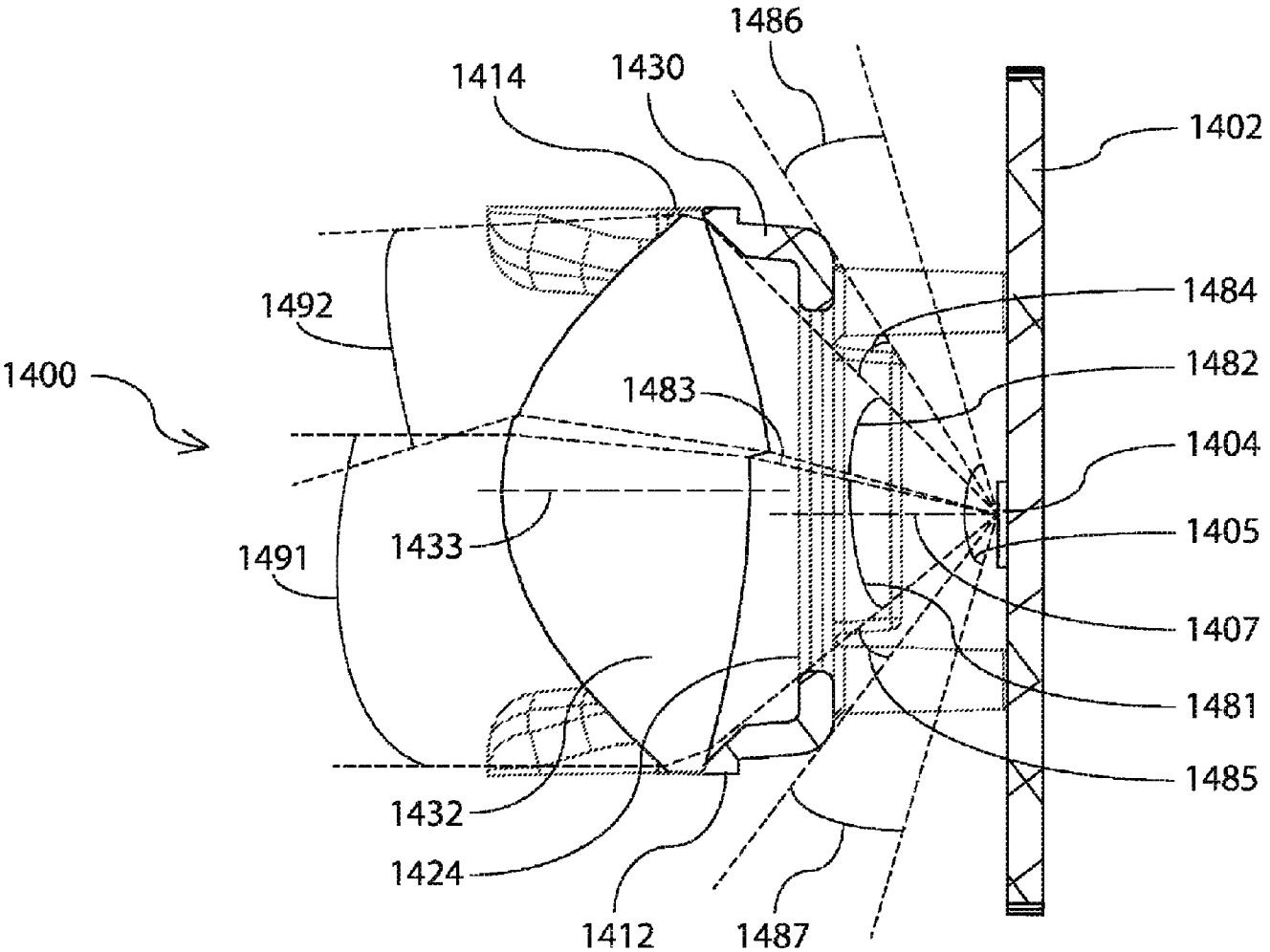
FIG. 14 illustrates a photometric diagram of a side cross-sectional view of a light collection and projection system in accordance with another embodiment of the present invention.

Turning to FIG. 13, a right side 1315 of a lens structure 1314 is exemplified, which may include one or more lenses 1332 for subtending light (e.g., by diffraction) emitted by one or more LEDs (e.g., LED 1404 of FIG. 14). Each lens 1332 may include one or more discrete regions (e.g., first and second regions 1333, 1335), and each discrete region may have similar or different foci to enable light to be subtended similarly or differently from each other region. For example, lens 1332 may have a first region 1333 with a first focus, and a second region 1335 with a second focus different from the first focus. In another example, a lens may have a first region with a first focus, a second region with a second focus, and a third region with a third focus. In this example, each of the first, second, and third foci may be similar or different.

Each discrete region may be formed by opposing surfaces of the lens 1332. For example, first region 1333 may be formed by a first inner surface 1371 and a first outer surface 1372. In another example, second region 1335 may be formed by a second inner surface 1375 and a second outer surface 1376. The first inner surface 1371 and second inner surface 1375 may be substantially in alignment, or may be substantially out of alignment (e.g., as exemplified in FIG. 13). The first outer surface 1372 and second outer surface 1376 may be substantially in alignment, or may be substantially out of alignment (e.g., as exemplified in FIG. 13). Thus, where corresponding surfaces may be out of alignment, a surface overhang (e.g., overhang 1377) and/or surface underhang (e.g., underhang 1378) may serve to join the unaligned surfaces.

Furthermore, while the disalignment of each of surfaces 1371, 1372, 1375, and 1376 are exemplified along a plane 1379 extending through lens 1332 (e.g., from right side 1315 to a side opposing right side 1315), this need not be the case. Plane 1379 of FIG. 13 merely illustrates one example where first region 1333 is divided from second region 1335 roughly along a single plane (e.g., plane 1379). A person of ordinary skill in the art will appreciate that the first and second regions may be divided along other planes (e.g., through a center of lens 1332), or may be divided along multiple planes corresponding to the inner and outer surfaces (not shown).

Turning to FIG. 14, a right side cross-sectional view of a light collection and projection system 1400 is exemplified, which may include a lens structure 1414 spaced with a first optimal separation distance from an LED 1404 on a PCBA 1402 to optimize subtending of light through lens structure 1414. The LED 1404 may be positioned to emit light in an effective span of emission 1405 and along an axis of symmetry 1407 of the effective span 1405.

The first optimal separation distance may be provided for by a carrier 1412, which may include one or more apertures (e.g., aperture 1424) corresponding to one or more lenses (e.g., lens 1432) of lens structure 1414. Axis of symmetry 1407 may be normal or inclined with respect to PCBA 1402 to optimize travel of effective span 1405 toward lens 1432. Furthermore, lens 1432 may have a central axis 1433 which may be collinear, parallel (as exemplified in FIG. 14), or inclined with respect to axis of symmetry 1407 to optimize light subtended (e.g., refracted) by lens 1432.

Aperture 1424 may permit at least a portion of the light emitted by LED 1404 to be subtended by lens 1432. For example, a first portion (e.g., span 1481) may travel from LED 1404 to a first distinct region (e.g., first region 1333 of FIG. 13) of lens 1432. Span 1481 may pass through lens 1432 and may be subtended (e.g., refracted) by lens 1432 to produce subtended span 1491. Subtended span 1491 may include light rays that travel in a direction substantially parallel to central axis 1433 of lens 1432 (e.g., collimated light).

In another example, a second portion (e.g., span 1482) may travel from LED 1404 to a second distinct region (e.g., second region 1335 of FIG. 13) of lens 1432. Span 1482 may pass through lens 1432 and may be subtended (e.g., refracted) by lens 1432 to produce subtended span 1492. Subtended span 1492 may include light rays that travel in a direction substantially inclined (e.g., downward) with respect to central axis 1433 of lens 1432 (e.g., focused light).

In another example, a third portion (e.g., span 1483) may travel from LED 1404 to a surface underhand and/or overhang region (e.g., overhang 1377 of FIG. 13) of lens 1432. Span 1483 may pass through lens 1432 and may be subtended (e.g., refracted) by lens 1432 to produce spill light (e.g., uncontrolled light). Due to the uncontrolled nature of span 1483, the surface underhang and/or overhang region may be minimized or eliminated so that span 1483 is relatively small compared to spans 1481, 1482. However, it may be impossible to completely eliminate the surface underhand and/or overhang region due to limitations of manufacturing processes.

While aperture 1424 may permit at least a portion of the light emitted by LED 1404 to be subtended by lens 1432, carrier 1412 may prevent at least a portion of the light emitted by LED 1404 from being subtended by lens 1432. Further, carrier 1412 may be spaced a second optimal separation distance from LED 1404 to optimize the degree to which light is prevented from passing to lens 1432. For example, a fourth portion (e.g., span 1484) and a fifth portion (e.g., span 1485) may each travel from LED 1404 toward carrier 1412 (e.g., bowl portion 1430). Carrier 1412 may subtend (e.g., reflect) the light away from lens 1432 and/or may absorb the light, such that light incident on carrier 1412 does not travel toward lens 1432.

Furthermore, a portion of light emitted by LED 1404 may travel away from both lens 1432 and carrier 1412. For example, a sixth portion (e.g., span 1486) and a seventh portion (e.g., span 1487) may travel away from LED 1404 without being incident on either lens structure 1414 or carrier 1412. Spans 1486, 1487 may be captured by other elements of an LED-based lighting system (e.g., LED-based lighting system 800 of FIG. 8) when light collection and projection system 1400 is positioned within such an LED-based lighting system. Thus, the only light which may exit from the LED-based lighting system during operation of the light collection and projection system 1400 may be subtended spans 1491 and 1492.

Furthermore, while axis of symmetry 1407 and central axis 1433 have been exemplified in FIG. 14 as being substantially horizontally disposed, light collection and projection system 1400 may be mounted within an LED-based lighting system in a substantially non-horizontal configuration. For example, one or both of axis of symmetry 1407 and central axis 1433 may be inclined with respect to a horizontal plane. In another example, axis of symmetry 1407 may have an incline with respect to a horizontal plane of between about 0.0 degrees and about 20 degrees (e.g., about 7.5 degrees). In another example, subtended span 1491 may have an incline with respect to a horizontal plane of between about 0.0 degrees and about 20 degrees (e.g., about 7.5 degrees). In another example, subtended span 1492 may have an incline with respect to a horizontal plane that is greater than an incline of subtended span 1491 with respect to the horizontal plane.

As with previous embodiments of the present invention, it is understood that changing the geometric relationship of lens structure 1414 and/or carrier 1412 with respect to LED 1404 may cause a modification of the target illuminance of light subtended by lens 1432. Thus, lens structure 1414 and/or carrier 1412 may be optimally positioned to achieve a desired target illuminance. Furthermore, each discrete region of lens 1432 may subtend the light passing through lens 1432 so that it travels from lens 1432 in a particular direction or directions (e.g., diffused, collimated, focused, and/or shifted light).

Figure 15:
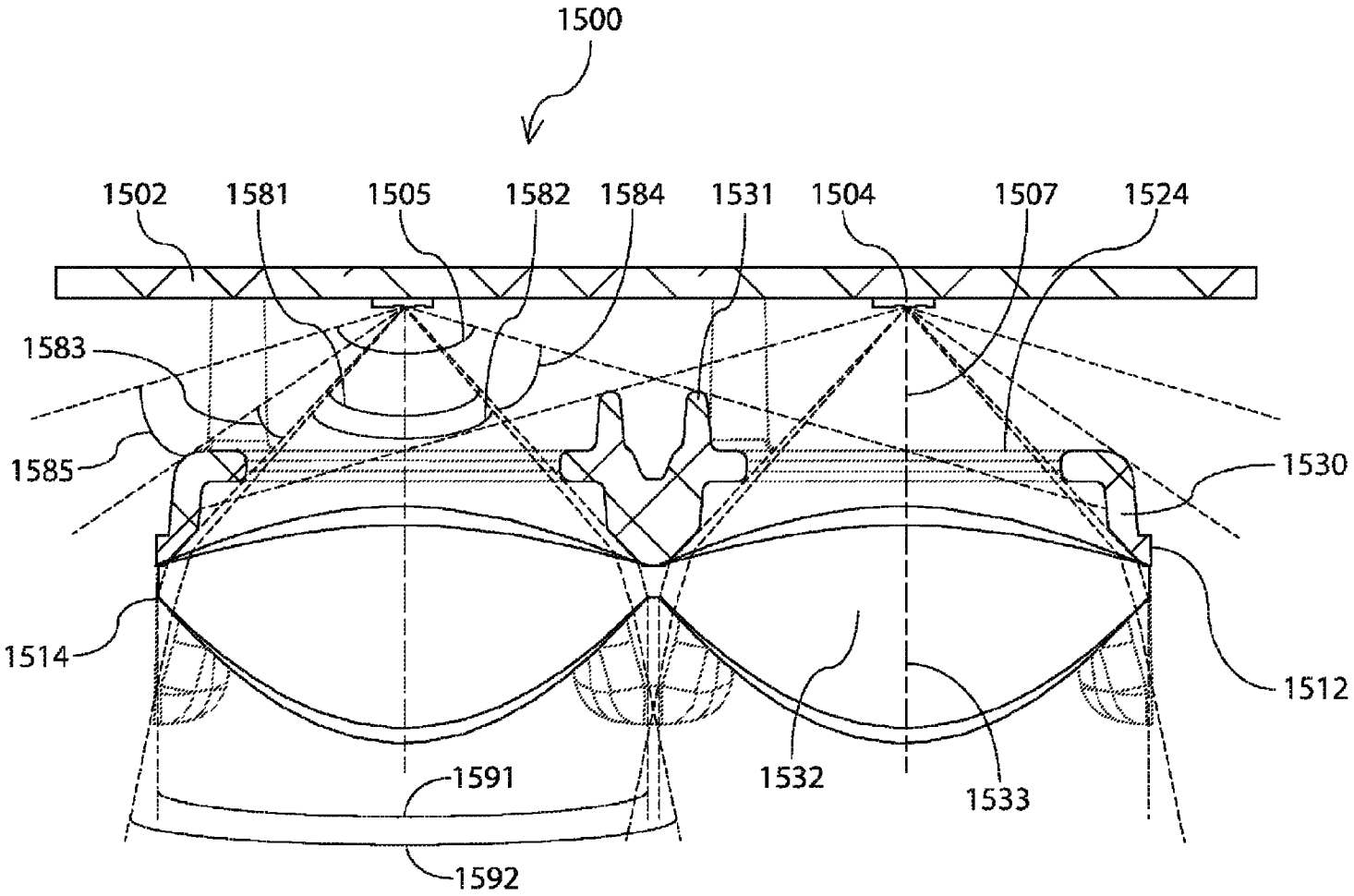
FIG. 15 illustrates a photometric diagram of a top cross-sectional view of a light collection and projection system in accordance with another embodiment of the present invention.

Turning to FIG. 15, a top side cross-sectional view of a light collection and projection system 1500 is exemplified, which may include a lens structure 1514 spaced with a first optimal separation distance from one or more LEDs 1504 on a PCBA 1502. The LEDs 1504 may each be positioned to emit light in an effective span of emission 1505 and along an axis of symmetry 1507 of respective effective spans 1505.

The first optimal separation distance may be provided for by a carrier 1512, which may include one or more apertures (e.g., apertures 1524) corresponding to one or more lenses (e.g., lenses 1532) of lens structure 1514. Axes of symmetry 1507 may be normal or inclined with respect to PCBA 1502 to optimize travel of effective spans 1505 toward lenses 1532. Furthermore, lenses 1532 may each have a central axis 1533 which may be collinear (as exemplified in FIG. 15), parallel, or inclined with respect to each axis of symmetry 1507, respectively, to optimize light subtended (e.g., refracted) by lenses 1532.

Each aperture 1524 may permit at least a portion of the light emitted by a single LED 1504 to be subtended by a single lens 1532, respectively. For example, a first portion of light (e.g., span 1581) may travel from a first LED 1504 to a first distinct region (e.g., first region 1333 of FIG. 13) of lens 1532. Span 1581 may pass through lens 1532 and may be subtended (e.g., refracted) by lens 1532 to produce subtended span 1591. Subtended span 1591 may include light rays that travel in a direction substantially parallel to central axis 1533 of lens 1532 (e.g., collimated light).

In another example, a second portion of light (e.g., span 1582) may travel from the first LED 1504 to a second distinct region (e.g., second region 1335 of FIG. 13) of lens 1532. Span 1582 may pass through lens 1532 and may be subtended (e.g., refracted) by lens 1532 to produce subtended span 1592. Subtended span 1592 may include light rays that travel in a direction substantially inclined (e.g., downward) with respect to central axis 1533 of lens 1532 (e.g., focused light). As exemplified in FIG. 15, subtended span 1592 may be non-collimated light.

While apertures 1524 may permit at least a portion of the light emitted by each LED 1504 to be subtended by a respective lens 1532, carrier 1512 may prevent at least a portion of the light emitted by LEDs 1504 from being subtended by any of lenses 1532. Further, carrier 1512 may be spaced a second optimal separation distance from LED 1504 to optimize the degree to which light is prevented from passing to lens 1532. For example, a third portion of light (e.g., span 1583) and a fourth portion of light (e.g., span 1584) may each travel from the first LED 1504 toward carrier 1512 (e.g., bowl portion 1530). Carrier 1512 may subtend (e.g., reflect) the light away from lens 1532 and/or may absorb the light, such that light incident on carrier 1512 does not travel toward lens 1532.

In addition, carrier 1512 may have one or more obstructions (e.g., walls 1531) extending between bowl portions 1530 and PCBA 1502 to further prevent passage of light from the first LED 1504 to a non-corresponding lens 1532 (e.g., a lens 1532 not immediately in front of the first LED 1504). Furthermore, a portion of light emitted by first LED 1504 may travel away from both lens 1532 and carrier 1512. For example, a fifth portion (e.g., span 1585) may travel away from first LED 1504 without being incident on either lens structure 1514 or carrier 1512. Span 1585 may be captured by other elements of an LED-based lighting system (e.g., bezel 802 of LED-based lighting system 800 of FIG. 8) when light collection and projection system 1500 is positioned within such an LED-based lighting system. Thus, the only light which may exit from the LED-based lighting system during operation of the light collection and projection system 1500 may be subtended spans 1591 and 1592.

Furthermore, while the above discussion has been made with reference to the first LED 1504, it is understood that similar spans and subtended spans may be produced with regard to additional LEDs (e.g., second, third, fourth, fifth, sixth, or more LEDs). In addition, although one or more obstructions (e.g., walls 1531) have been illustrated in FIG. 15 as between two axes of symmetry 1507 of two opposing LEDs 1504, it is understood that one or more obstructions may be disposed between any and/or every LED in a system with more than two LEDs.

Based on the foregoing embodiments and descriptions, it may be understood that a light collection and projection system may include a lens structure (e.g., lens structure 914 of FIG. 9) interconnected with a carrier (e.g., carrier 912 of FIG. 9), the lens structure spaced from one or more LEDs (e.g., LEDs 1504 of FIG. 15) on a PCBA (e.g., PCBA 902 of FIG. 9) by the carrier. Furthermore, the lens structure may have one or more lenses (e.g., lens 1332 of FIG. 13), each lens having one or more discrete regions (e.g., first and second regions 1333, 1335 of FIG. 13), and each discrete region having a focus, respectively.

The focus of each region may be defined by the depth and curvature of each region, respectively. For example, the focus of a region may be defined by the relative distance between inner and outer surfaces of that region along its span in any direction (e.g., the distance between first inner surface 1371 and first outer surface 1372). Furthermore, the focus of each region may be selected to produce a particular subtending of light (e.g., no effect, diffusion of light, focusing of light, collimating of light, shifting of light, or any combination thereof). For example, a first region may be appropriately shaped to collimate light along a vertical span (e.g., as exemplified with lens 1432 in FIG. 14) and to collimate light along a horizontal span (e.g., as exemplified with lens 1532 in FIG. 15). In another example, a second region may be appropriately shaped to focus and shift light (e.g., bend it downward) along a vertical span (e.g., as exemplified with lens 1432 in FIG. 14) and to focus light along a horizontal span (e.g., as exemplified with lens 1532 in FIG. 15).

A person of ordinary skill in the art will appreciate the limitations of conveying this invention in various drawings as herein disclosed. However, it is understood that a region of a lens may have any one or more of the above described characteristics of subtending light. In another example, a discrete region may collimate light in a first span (e.g., along a height) and diffuse light in a second span (e.g., along a width) normal to the first span. In another example, a discrete region may have no effect on the light in a first span and shift the light in a second span normal to the first span.

In general, a lens having only one discrete region may be capable of producing a single light projection at a distance forward of a LED-based lighting system. Alternately, a lens having two or more discrete regions may be capable of producing two or more light projections at the distance forward of the LED-based lighting system. The two or more light projections may be separate, bordering each other, or overlapping. Furthermore, each light projection may have similar or different characteristics of subtending light to every other light projection. Thus, the lens having two or more discrete regions may be more versatile and, therefore, better able to provide light forwardly of the LED-based lighting system in accordance with specialized needs.

Figure 16:
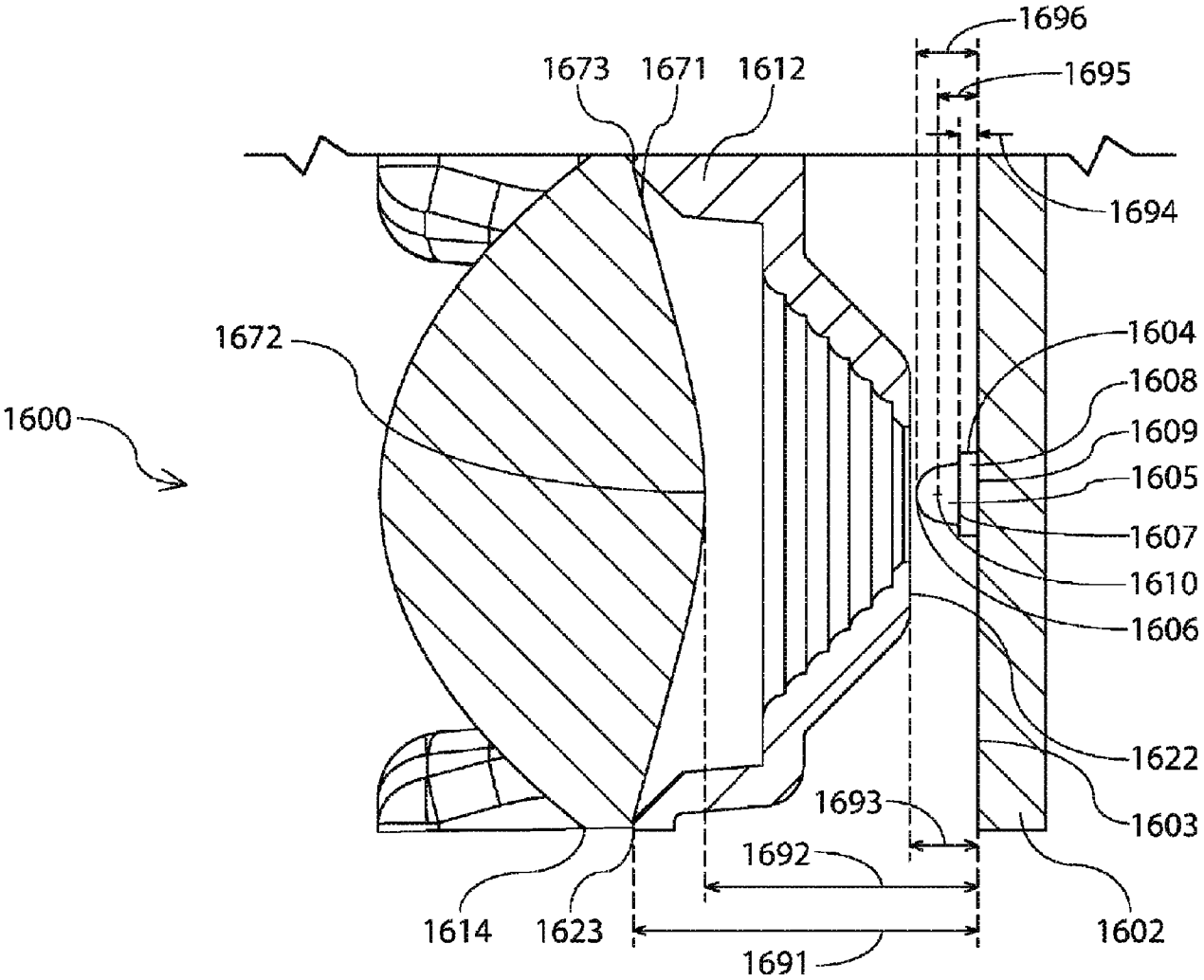
FIG. 16 illustrates a cross-sectional view of a segment of the light collection and projection system of FIG. 10.

Turning to FIG. 16, a cross-sectional segment of a light collection and projection system 1600 is exemplified, which may include a lens structure 1614 spaced from one or more LEDs 1604 on a PCBA 1602 by a carrier 1612. Lens structure 1614 may be spaced with a first optimal separation distance from the LEDs 1604, and carrier 1612 may be spaced with a second optimal separation distance from the LEDs 1604. The first and second optimal separation distances may be defined by one or more surfaces of lens structure 1614, one or more surfaces of carrier 1612, and/or one or more surfaces and/or regions of LEDs 1604.

Lens structure 1614 may include a rearward surface 1671, which may be positioned to be facing PCBA 1602. For example, rearward surface 1671 of lens structure 1614 may include a curvature (e.g., having a convex shape) with a rearward tip 1672 and a forward perimeter 1673. Forward perimeter 1673 may be spaced from PCBA 1602 by a distance 1691, and rearward tip 1672 may be spaced from PCBA 1602 by a distance 1692. One or both of distances 1691 and 1692 may contribute to the first optimal separation distance of lens structure 1614 from LEDs 1604.

Carrier 1612 may include a rearward surface 1622 positioned to be facing PCBA 1602, and a forward surface 1623 facing oppositely of rearward surface 1622. Forward surface 1623 may be spaced from PCBA 1602 by a distance 1691 (e.g., abutting forward perimeter 1673 of lens structure 1614), and rearward surface 1622 may be spaced from PCBA 1602 by a distance 1693. One or both of distances 1691 and 1693 may contribute to the second optimal separation distance of carrier 1612 from LEDs 1604.

PCBA 1602 may include a forward surface 1603 upon which the one or more LEDs 1604 may be secured. LEDs 1604 may include a rearward portion 1608 secured to forward surface 1603 of PCBA 1602, and a forward portion 1605 secured to rearward portion 1608. For example, rearward portion 1608 may include a rearward surface 1609 which abuts forward surface 1603 of PCBA 1602 (e.g., the distance between rearward surface 1609 of rearward portion 1608 and forward surface 1603 of PCBA 1602 may be zero).

In another example, LEDs 1604 may have a deck 1607 upon which a light source may be located. Deck 1607 may face oppositely of rearward surface 1609 from rearward portion 1608. Deck 1607 may be spaced from PCBA 1602 by a distance 1694, which may contribute to one or both of the first and second optimal separation distances.

In another example, forward portion 1605 of LEDs 1604 may extend from rearward portion 1608 (e.g., from deck 1607). Forward portion 1605 may enclose a light source (e.g., the light source positioned on deck 1607), and may be dome shaped. Forward portion 1605 may include a forward tip 1606 spaced a distance 1696 from PCBA 1602. Forward tip 1606 may represent a distance of the one or more LEDs 1604 that is furthest from PCBA 1602. Distance 1696 may contribute to one or both of the first and second optimal separation distances.

In another example, forward portion 1605 of LED 1604 may include an intermediate position 1610 located between deck 1607 and forward tip 1606. For example, intermediate position 1610 may be ½, ⅓, ⅔, ¼, ¾, ⅕, ⅖, ⅗, or ⅘, of the way from deck 1607 to forward tip 1606. Intermediate position 1610 may be spaced from PCBA 1602 by a distance 1695, which may contribute to one or both of the first and second optimal separation distances.

As discussed above, each of distances 1691-1696 may contribute to one or both of the first and second optimal separation distances. The first optimal separation distance (OSD1), or the distance between lens structure 1614 and LEDs 1604, may be represented by any one or more of equations (2)-(7) as:

$$OSD1=1691, \quad (2)$$

$$OSD1=1691\text{-}1694, \quad (3)$$

$$OSD1=1691\text{-}1695, \quad (4)$$

$$OSD1=1691\text{-}1696, \quad (5)$$

$$OSD1=1692, \quad (6)$$

$$OSD1=1692\text{-}1694, \quad (7)$$

$$OSD1=1692\text{-}1695, \quad (8)$$

$$OSD1=1692\text{-}1696, \quad (9)$$

Where OSD1 is the first optimal separation distance, and 1691-1696 are the distances as herein described. For example, OSD1 as exemplified by equation (2), above, may be between about 0.4 inches and about 0.6 inches (e.g., about 0.506 inches). In another example, OSD1 as exemplified by equation (3), above, may be between about 0.477 inches and about 0.485 inches (e.g., about 0.481 inches). In another example, OSD1 as exemplified by equation (4), above, may be between about 0.428 inches and about 0.473 inches (e.g., about 0.450 inches). In another example, OSD1 as exemplified by equation (5), above, may be between about 0.416 inches and about 0.422 inches (e.g., about 0.419 inches). In another example, OSD1 as exemplified by equation (6), above, may be between about 0.3 inches and about 0.5 inches (e.g., about 0.401 inches). In another example, OSD1 as exemplified by equation (7), above, may be between about 0.372 inches and about 0.380 inches (e.g., about 0.376 inches). In another example, OSD1 as exemplified by equation (8), above, may be between about 0.323 inches and about 0.368 inches (e.g., about 0.345 inches). In another example, OSD1 as exemplified by equation (9), above, may be between about 0.311 inches and about 0.317 inches (e.g., about 0.314 inches).

The second optimal separation distance (OSD2), or the distance between carrier 1612 and LEDs 1604, may be represented by any one or more of equations (8)-(13) as:

$$OSD2=1691, \quad (10)$$

$$OSD2=1691\text{-}1694, \quad (11)$$

$$OSD2=1691\text{-}1695, \quad (12)$$

$$OSD2=1691\text{-}1696, \quad (13)$$

$$OSD2=1693, \quad (14)$$

$$OSD2=1693\text{-}1694, \quad (15)$$

$$OSD2=1693\text{-}1695, \quad (16)$$

$$OSD2=1693\text{-}1696, \quad (17)$$

Where OSD2 is the second optimal separation distance, and 1691-1696 are the distances as herein described. For example, OSD2 as exemplified by equation (10), above, may be between about 0.4 inches and about 0.6 inches (e.g., about 0.506 inches). In another example, OSD2 as exemplified by equation (11), above, may be between about 0.477 inches and about 0.485 inches (e.g., about 0.481 inches). In another example, OSD2 as exemplified by equation (12), above, may be between about 0.428 inches and about 0.473 inches (e.g., about 0.450 inches). In another example, OSD2 as exemplified by equation (13), above, may be between about 0.416 inches and about 0.422 inches (e.g., about 0.419 inches). In another example, OSD2 as exemplified by equation (14), above, may be between about 0.09 inches and about 0.11 inches (e.g., about 0.10 inches). In another example, OSD2 as exemplified by equation (15), above, may be between about 0.071 inches and about 0.079 inches (e.g., about 0.075 inches). In another example, OSD2 as exemplified by equation (16), above, may be between about 0.022 inches and about 0.067 inches (e.g., about 0.045 inches). In another example, OSD2 as exemplified by equation (17), above, may be between about 0.01 inches and about 0.016 inches (e.g., about 0.013 inches).

A person of ordinary skill in the art will appreciate that the above ranges are given as examples only, and may be optimal for a specified LED (e.g., an Oslon 80 LED). Thus, a system incorporating LEDs of different sizes may necessarily require different first and second optimal separation distances than those exemplified. Nevertheless, such differently sized LEDs may be optimally spaced from corresponding lens structures and/or carriers to achieve the objectives outlined by the present invention.

While FIG. 16 exemplifies a lens structure and carrier similar to the configuration illustrated with respect to FIGS. 1-5, it is understood that the same principles of determining an optimal separation distance may be applied to the lens structure and carrier configuration illustrated with respect to FIGS. 8-15. Furthermore, a person of ordinary skill in the art will appreciate that the light collection and projection systems of the foregoing embodiments may be scalable to other sizes than those specifically referenced in any of the preceding examples (e.g., to smaller and/or larger sizes).

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. An LED-based lighting system, comprising:

a PCBA having an LED; and a lens configured over the LED to subtend light from the LED, the lens including a first discrete region formed of a first convex inner surface and a first convex outer surface, the first discrete region forming a first focus, the lens including a second discrete region formed of a second convex inner surface and a second convex outer surface, the second discrete region forming a second focus, wherein the first inner surface is out of alignment with the second inner surface forming an overhang, the first outer surface is out of alignment with the second outer surface forming an underhang, and wherein the overhang and underhang extend along a plane extending at an incline to a central axis of the lens.

2. The LED-based lighting system of claim 1, wherein the first focus of the first discrete region causes light to be subtended into a first subtended span of collimated light.

3. The LED-based lighting system of claim 2, wherein the collimated light travels in a direction substantially parallel to a central axis of the lens.

4. The LED-based lighting system of claim 2, wherein the collimated light travels in a direction substantially parallel to an axis of symmetry of light emitted by the LED.

5. The LED-based lighting system of claim 1, wherein the second focus of the second discrete region causes light to be subtended into a second subtended span of focused light.

6. The LED-based lighting system of claim 5, wherein the focused light travels in a direction substantially non-parallel to a central axis of the lens.

7. The LED-based lighting system of claim 5, wherein the focused light travels in a direction substantially non-parallel to an axis of symmetry of light emitted by the LED.

8. The LED-based lighting system of claim 1, wherein a central axis of the lens is offset from and parallel to an axis of symmetry of light emitted by the LED.

9. The LED-based lighting system of claim 1, wherein the lens is spaced from the LED to achieve a target illuminance.

10. A method, comprising:

emitting light from an LED in an effective span of emission;

forming a lens with a first discrete region out of alignment with a second discrete region along a plane extending at an incline with respect to a central axis of the lens, wherein the first and second discrete regions form one or more of an overhang and an underhang, wherein the first discrete region is formed by a first convex inner surface and a first convex outer surface, wherein the second discrete region is formed by a second convex inner surface and a second convex outer surface;

passing a first portion of the effective span through the first discrete region to produce a first subtended span of light; and passing a second portion of the effective span through the second discrete region to produce a second subtended span of light.

11. The method of claim 10, wherein the first subtended span of light is collimated light, and the second subtended span of light is focused light.

12. The method of claim 10, further including:

passing the first subtended span of light in a direction substantially parallel to a central axis of the lens, and passing the second subtended span of light in a direction substantially non-parallel to a central axis of the lens.

13. The method of claim 10, further including:

passing the first subtended span of light in a direction substantially parallel to the axis of symmetry of the effective span of emission, and passing the second subtended span of light in a direction substantially non-parallel to the axis of symmetry of the effective span of emission.

14. The method of claim 10, further including:

subtending the emitted light from the LED through a first inner surface of the first discrete region to produce first refracted light; and subtending the first refracted light through a first outer surface of the first discrete region to produce the first subtended span of light.

15. The method of claim 14, further including:

subtending the emitted light from the LED through a second inner surface of the second discrete region to produce second refracted light; and subtending the second refracted light through a second outer surface of the second discrete region to produce the second subtended span of light.

16. An LED-based lighting system, comprising:

a PCBA having an LED; and a lens configured over the LED to subtend light from the LED, the lens including a first convex inner surface and a first convex outer surface, and a second convex inner surface and a second convex outer surface;

wherein the first inner surface is out of alignment with the second inner surface forming an overhang, and the first outer surface is out of alignment with the second outer surface forming an underhang; and wherein the overhang and underhang extend along a plane extending at an incline to a central axis of the lens.

17. The LED-based lighting system of claim 16, wherein the first inner surface and the first outer surface form a first discrete region exhibiting a first focus, and wherein the second inner surface and the second outer surface form a second discrete region exhibiting a second focus.

18. The LED-based lighting system of claim 17, wherein the first focus of the first discrete region causes light to be subtended into a first subtended span traveling in a first direction, and wherein the second focus of the second discrete region causes light to be subtended into a second subtended span travelling in a second direction different from the first direction.

19. The LED-based lighting system of claim 1, wherein the first focus is different from the second focus.

20. The LED-based lighting system of claim 17, wherein the first focus is different from the second focus.

* * * * *